US012484681B2

(12) United States Patent
Lee et al.

(10) Patent No.: US 12,484,681 B2
(45) Date of Patent: Dec. 2, 2025

(54) GRINDING COMPACT CONTAINER

(71) Applicant: SAMHWA CO., LTD, Uiwang-si (KR)

(72) Inventors: Kyungchang Lee, Uiwang-si (KR); Kwan Ho Lee, Suwon-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 263 days.

(21) Appl. No.: 18/352,587

(22) Filed: Jul. 14, 2023

(65) Prior Publication Data

US 2024/0398093 A1 Dec. 5, 2024

(30) Foreign Application Priority Data

Jun. 1, 2023 (KR) ..... 10-2023-0070706

(51) Int. Cl.

| | |
|---|---|
| ***A45D 33/26*** | (2006.01) |
| ***A45D 33/02*** | (2006.01) |
| ***A45D 33/04*** | (2006.01) |
| *A45D 33/00* | (2006.01) |

(52) U.S. Cl.

CPC ..... *A45D 33/26* (2013.01); *A45D 33/025* (2013.01); *A45D 33/04* (2013.01); *A45D 2033/001* (2013.01)

(58) Field of Classification Search

CPC ..... A45D 33/04; A45D 33/025; A45D 33/26

See application file for complete search history.

(56) References Cited

U.S. PATENT DOCUMENTS

| | | | | |
|---|---|---|---|---|
| 1,804,943 | A * | 5/1931 | Maillard | A45D 33/025 132/299 |
| 8,387,627 | B2 * | 3/2013 | Yeom | A45D 33/06 209/384 |
| 11,832,703 | B2 | 12/2023 | Lee et al. | |
| 2008/0251096 | A1 * | 10/2008 | Eng | A45D 33/025 132/294 |
| 2008/0276956 | A1 * | 11/2008 | Cho | A45D 33/04 132/294 |
| 2011/0126851 | A1 * | 6/2011 | Yeom | A45D 33/06 132/293 |

(Continued)

FOREIGN PATENT DOCUMENTS

| | | | |
|---|---|---|---|
| KR | 10-2101103 | B1 | 4/2020 |
| KR | 10-2279516 | B1 | 7/2021 |

(Continued)

*Primary Examiner* — Nicholas D Lucchesi

(74) *Attorney, Agent, or Firm* — Bridgeway IP Law Group, PLLC; Jihun Kim

(57) ABSTRACT

A grinding compact container is disclosed, which dispenses a content in a ground form when a dial cover is rotated. A grinding compact container can include: a stationary container that defines a mounting space; a rotary container that defines a holding space and is rotatable in relation to the stationary container; a content holder that is movable along a longitudinal direction but non-rotatable in relation to the stationary container; a dial cover that has a cutter for grinding the solid content on its lower surface and is coupled to the rotary container in a non-rotatable manner relative to the rotary container; and an elastic member that is arranged in a compressed state in the holding space under the content holder to push the upper surface of the content holder towards the dial cover.

12 Claims, 15 Drawing Sheets

(56) References Cited

U.S. PATENT DOCUMENTS

| | | | | |
|---|---|---|---|---|
| 2012/0048294 | A1* | 3/2012 | Yeom | A45D 33/04 132/299 |
| 2021/0059383 | A1* | 3/2021 | Cho | A45D 40/0075 |
| 2021/0378382 | A1* | 12/2021 | Lee | A45D 33/04 |
| 2022/0095767 | A1* | 3/2022 | Lee | A45D 33/14 |

FOREIGN PATENT DOCUMENTS

| | | | |
|---|---|---|---|
| KR | 10-2317355 | B1 | 10/2021 |
| KR | 10-2021-0150145 | A | 12/2021 |

* cited by examiner

GRINDING COMPACT CONTAINER

CROSS-REFERENCE TO RELATED APPLICATIONS

This application claims the benefit of Korean Patent Application No. 10-2023-0070706, filed with the Korean Intellectual Property Office on Jun. 1, 2022, the disclosure of which is incorporated herein by reference in its entirety.

BACKGROUND

1. Technical Field

The present invention relates to a cosmetic container, more particularly to a grinding compact container that dispenses a content in a ground form when a dial cover is rotated.

2. Description of the Related Art

A typical compact container holds a content of a powder form, allowing the user to apply the content after dabbing it with a puff. Since the content is provided in a powder form in such a compact container, there is a risk of the content spilling out and causing a great mess in the surrounding area if the compact container were to be opened unintentionally when not in use or if an impact is applied during the use of the compact container. To resolve this problem, certain compact containers have powder content compressed into a solidified form. In this case, the content held as a compressed powder is less likely to spill or disperse into the air, but a few shortcomings still remain, as it may be difficult to get the powder onto the puff, and the powder may not be evenly distributed on the puff.

As a solution to the shortcomings above, a grinding container has been developed, which is a contain that grinds the compressed powder into even particles immediately before use as manipulated by the user. Such a grinding container is disclosed in Korean Registered Patent No. 10-2279516, among others. When using a typical grinding container, the user may rotate a part of the grinding container known as the dial cover, where the rotation may move the content held in the container upward and cause the content to be ground by a cutter provided under the dial cover.

Here, the rotating action applied by the user on the grinding container has to move all of the content upward, which can make the use of the container inconvenient, since the mass of the content causes the user to feel a weighty sensation, and the rotating action requires a relatively large amount of force. Also, since the amount of content that is ground is not exactly proportional to the degree of rotation of the dial cover, the user's rotation of the dial cover can cause the content to move upward excessively, causing the dial cover to become detached from the container body. This problem can be exacerbated when a large force is required for the rotating action as mentioned above. That is, because a large force is normally required for rotating a part of the grinding container, even when a user is applying an excessive amount of force, the user may not perceive that such is the case.

SUMMARY OF THE INVENTION

An aspect of the present invention, which was conceived to resolve the problems described above, is to provide a grinding compact container that can reduce the amount of force required by the rotating action for grinding the content.

Another aspect of the invention is to provide a grinding compact container that can prevent the dial cover from experiencing an excessive force of an extent that may cause the dial cover to become detached.

Other objectives of the present invention will be more clearly understood from the embodiments set forth below.

A grinding compact container according to an aspect of the invention can include: a stationary container on an inner side of which an upwardly open mounting space is formed; a rotary container that forms an upwardly open holding space on its inner side and is coupled to the stationary container from within the mounting space such that the rotary container is rotatable in relation to the stationary container; a content holder that is arranged in the holding space and is configured to support a solid content on an upper surface thereof, where the content holder is coupled to the stationary container such that it is movable along a longitudinal direction but non-rotatable in relation to the stationary container; a dial cover, on a lower surface of which a cutter for grinding the solid content is provided, and in which a dispensing hole is formed, where the dispensing hole penetrates the dial cover along the longitudinal direction to allow a dispensing of the ground solid content, and the dial cover is coupled to an upper portion of the rotary container in a non-rotatable manner relative to the rotary container; and an elastic member that is arranged in a compressed state in the holding space under the content holder to push the upper surface of the content holder towards the dial cover.

A grinding compact container according to an embodiment of the present invention can include one or more of the following features. For example, a passage can be formed in the center of the rotary container, the stationary container can include a first insert-joint part extending upward through the passage, and the content holder can include a second insert-joint part extending downward from its lower surface. Here, one of the first insert-joint part and the second insert-joint part can include a sleeve, on an inner side of which a space may be formed, the other of the first insert-joint part and the second insert-joint part can include a protruding part that is inserted to the inner side of the sleeve, and the protruding part can have a non-circular cross section to prevent the content holder from rotating in relation to the stationary container but permit the content holder to move along the longitudinal direction in relation to the stationary container.

The rotary container can include a first screw-joint part extending upward, and the content holder can include a second screw-joint part extending downward. Here, one of the first screw-joint part and the second screw-joint part can include a thread, and the other of the first screw-joint part and the second screw-joint part can include a gear protrusion engaged with the thread.

The length of the thread along the longitudinal direction can be smaller than the distance between the upper surface of the content holder and the lower surface of the dial cover.

A passage that opens upward and downward can be formed on the inner side of the first screw-joint part, and the stationary container can include a coupling boss that extends upward to be inserted through the passage. Here, the coupling boss can include a multiple number of detent members, each of which can have a detent protrusion formed on the outer side. The stationary container can have a tolerance hole formed therein at a location adjacent to the detent member. The coupling boss can further include a multiple number of fixed members, where the multiple fixed members and the multiple detent members can be arranged alternatingly.

The elastic member can be a coil spring having one end, with respect to the longitudinal direction, formed with a larger diameter than the other end so as to form a generally frustoconical shape.

The content holder can include a contact part that is configured to contact the side wall of the rotary container, and the elastic member can be arranged such that the one end of the elastic member having the larger diameter contacts the inner perimeter of the contact part, so that the elastic member both pushes the rotary container upward and pushes the contact part outward.

The grinding compact container can further include a holder guide that is arranged in the holding space and includes a guide column extending along the longitudinal direction. In this case, a slit can be formed in the solid content and the content holder, and the content holder can be arranged over the holder guide such that the guide column penetrates through the slit. The holder guide can further include a disk part that is rotatably placed on an upper surface of a base of the rotary container, the guide column can extend upward from the disk part, and the elastic member can be arranged on an inner side of the guide column.

An embodiment of the present invention having the features above can provide various advantageous effects including the following. However, an embodiment of the present invention may not necessarily exhibit all of the effects below.

A grinding compact container according to an embodiment of the present invention can provide the user with a comfortable feel by minimizing friction between components and by using an elastic member that pushes the content holder upward so that the dial cover may be rotated without requiring a large force.

A grinding compact container according to an embodiment of the present invention can also prevent the dial cover from becoming detached by an excessive force by using an elastic member to move the content holder upward.

DETAILED DESCRIPTION OF THE INVENTION

Figure 1:
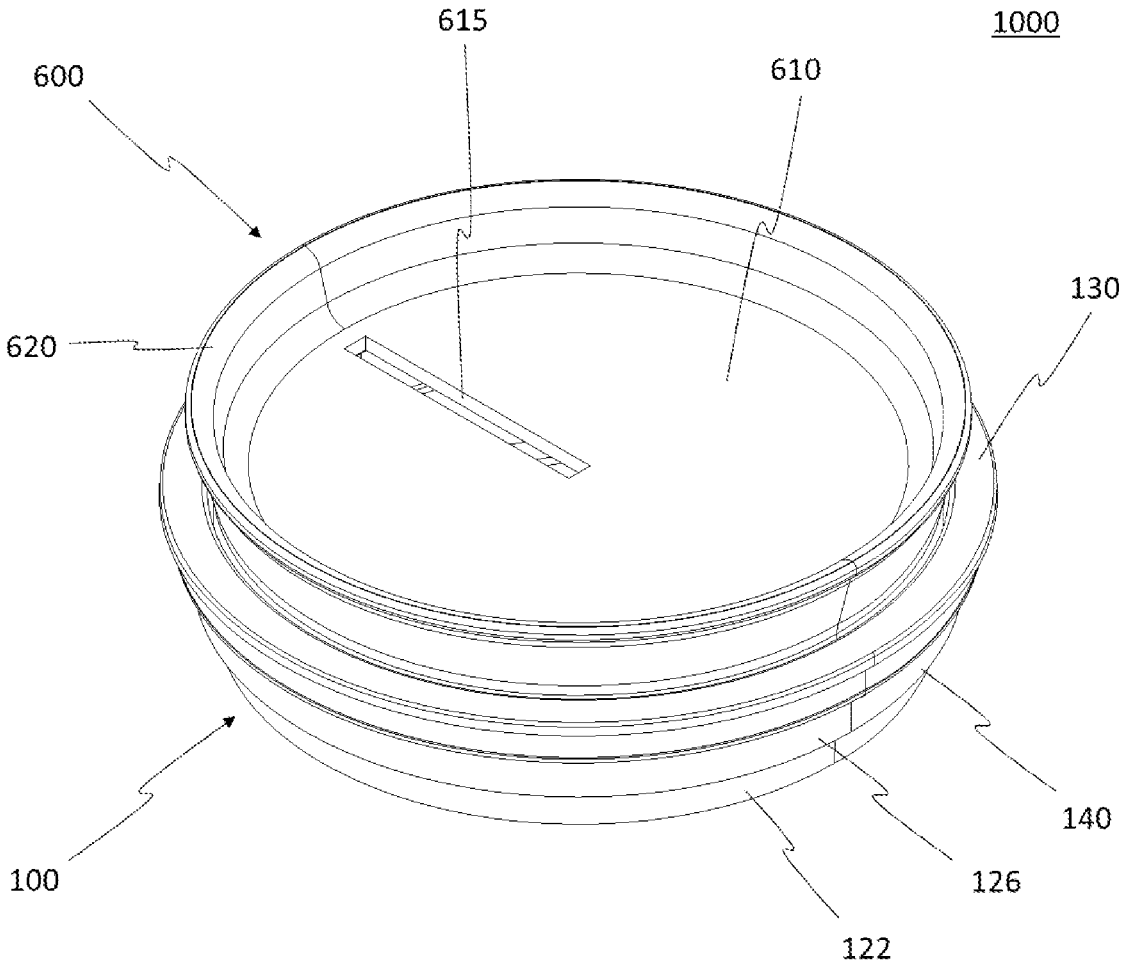
FIG. 1 is a perspective view illustrating a grinding compact container according to an embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

For the sake of convenience, the specification uses terms such as "inner," "outer," "upper," and "lower." In the descriptions that follow, the term "inner" refers to a side closer to the interior of the grinding compact container 1000, while the term "outer side" refers to a side further away from the interior of the grinding compact container 1000. The terms "upper" and "lower" refer to the upper and lower directions for a grinding compact container 1000 oriented as in FIGS. 1 to 4. Of course, during actual use of a grinding compact container 1000 according to an embodiment of the invention, an upward direction mentioned in the specification may not necessarily coincide with the actual upward direction.

Figure 2:
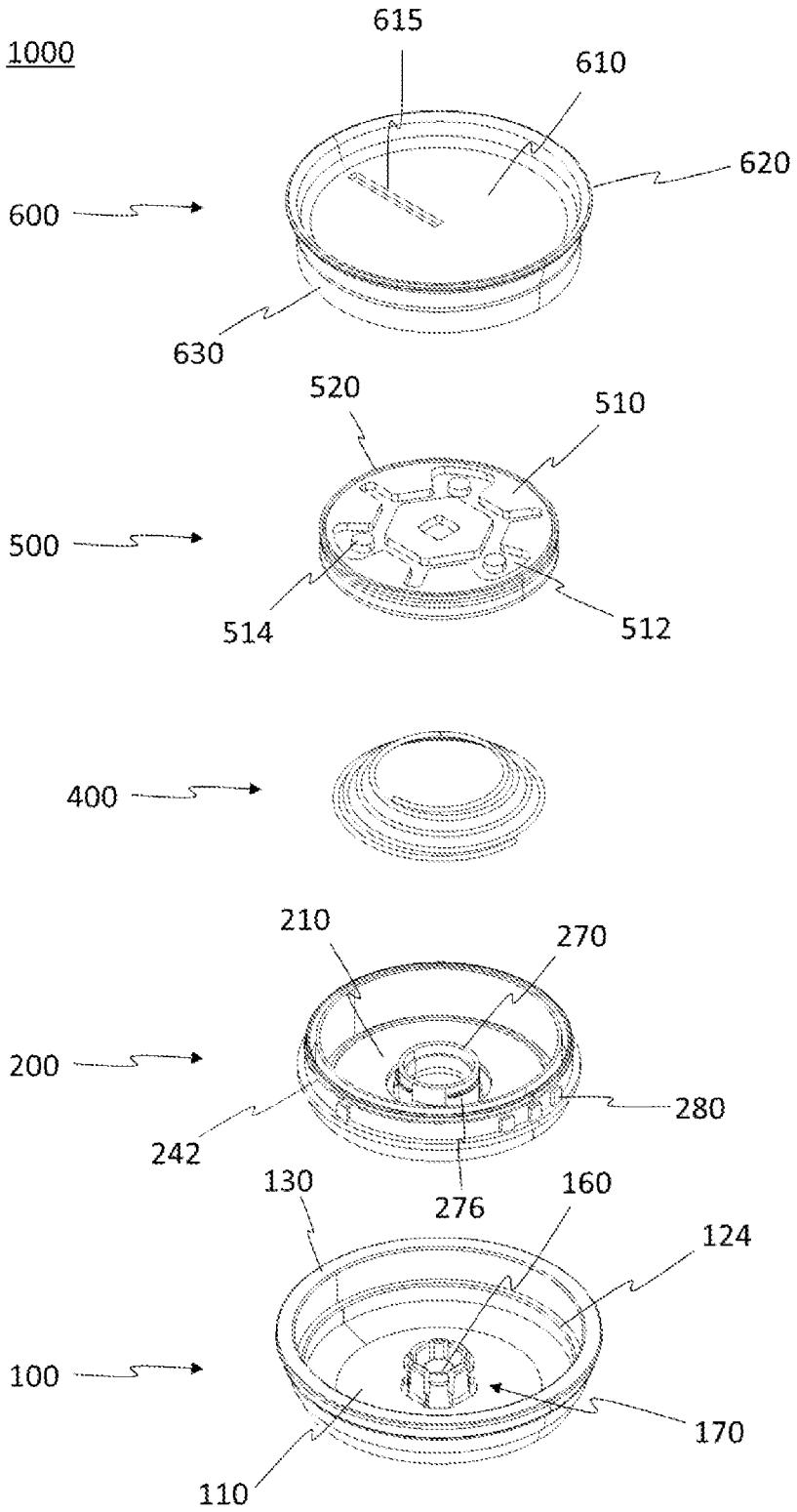
FIG. 2 is an exploded perspective view illustrating a grinding compact container according to an embodiment of the invention.
Figure 3:
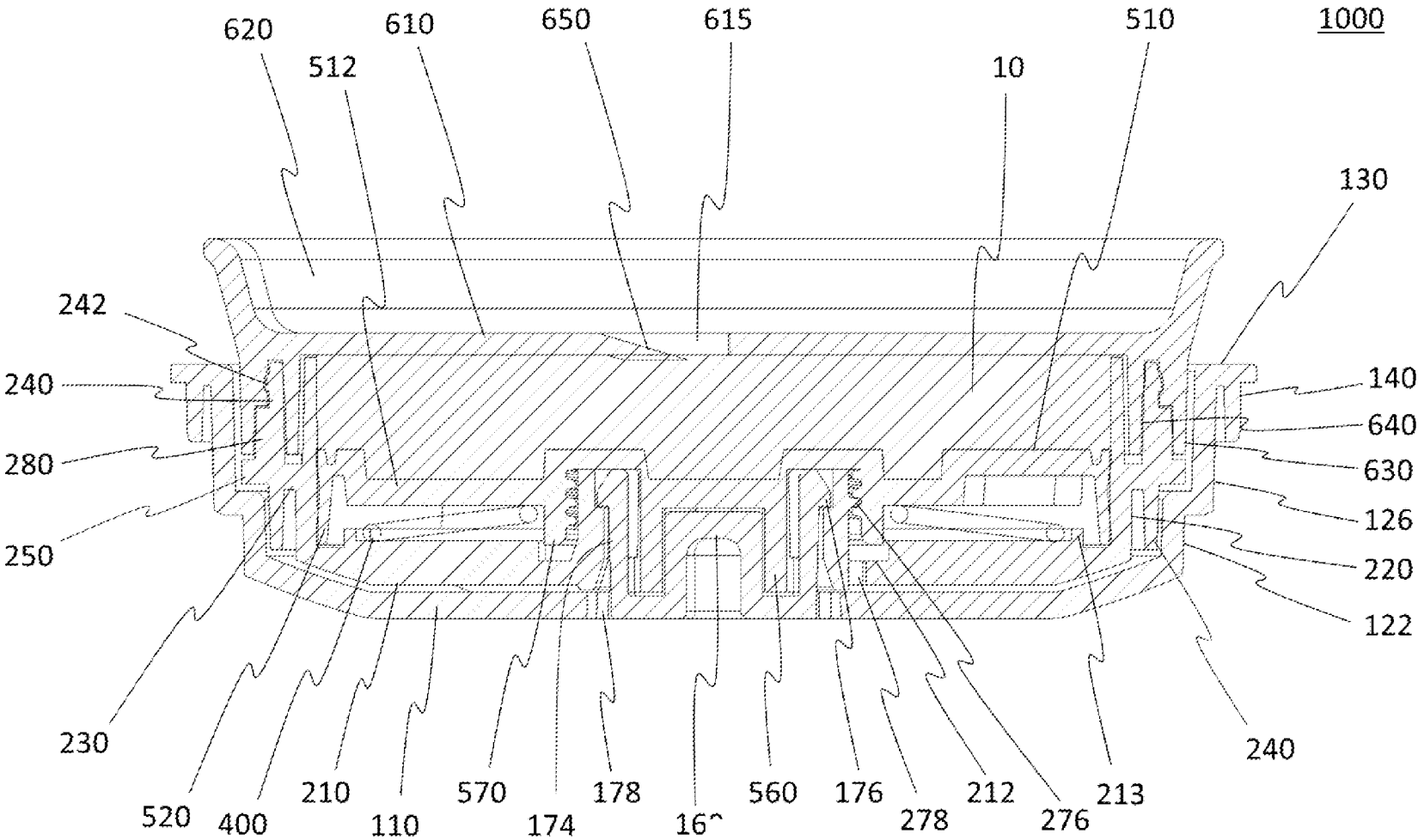
FIG. 3 is a cross-sectional view illustrating a grinding compact container according to an embodiment of the invention.
Figure 4:
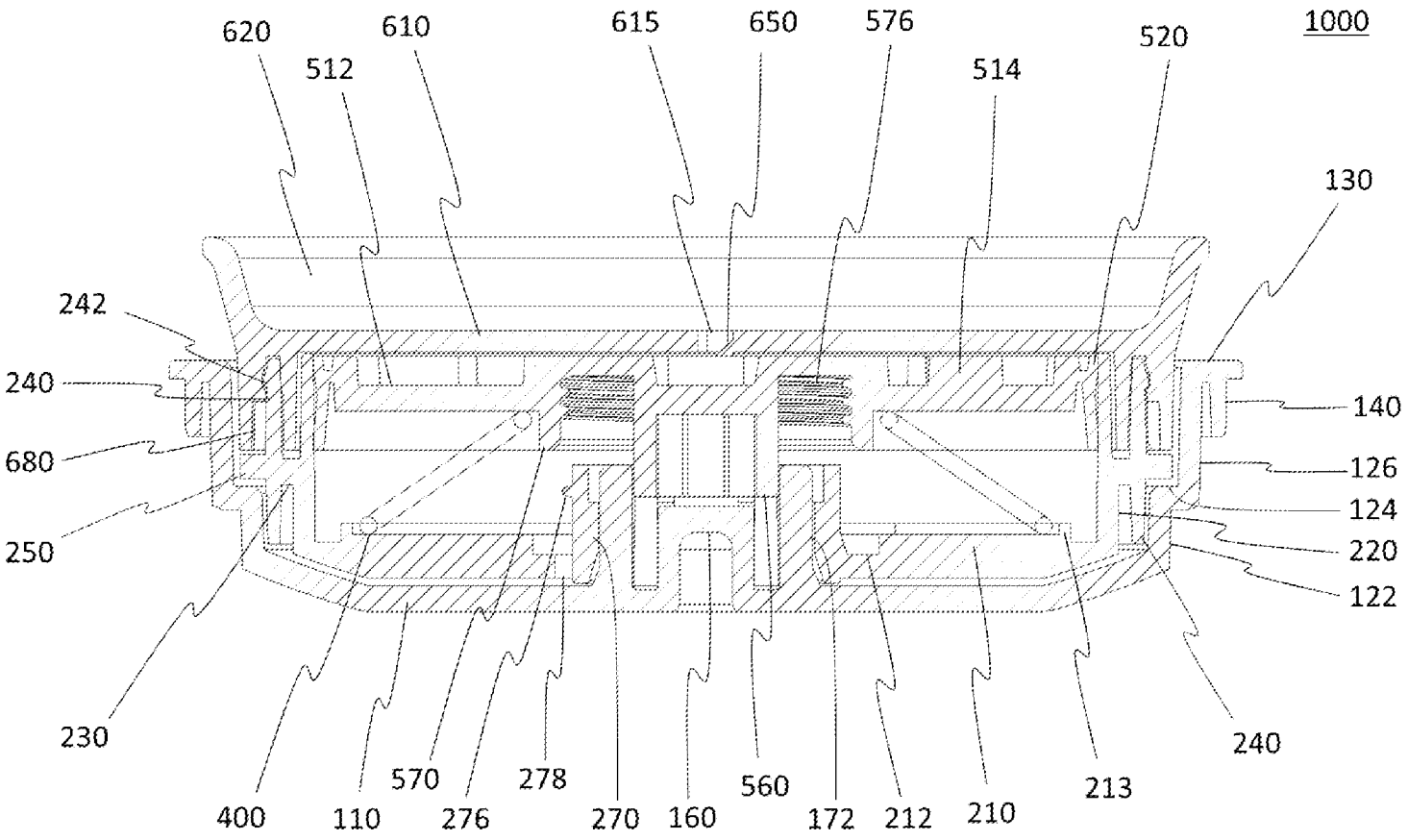
FIG. 4 is a cross-sectional view illustrating a grinding compact container according to an embodiment of the invention.
Figure 5:
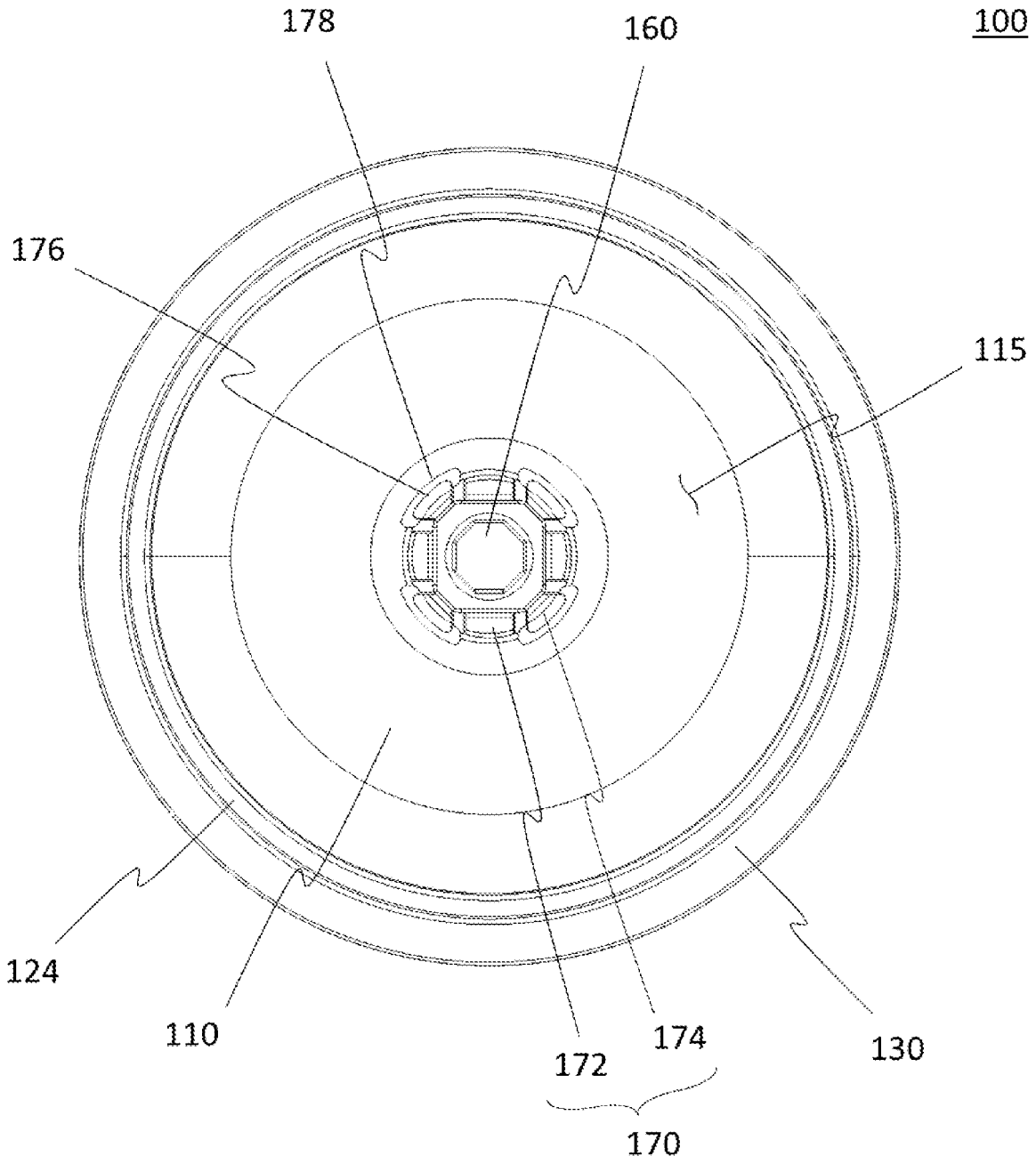
FIG. 5 is a top view illustrating the stationary container of a grinding compact container according to an embodiment of the invention.
Figure 6:
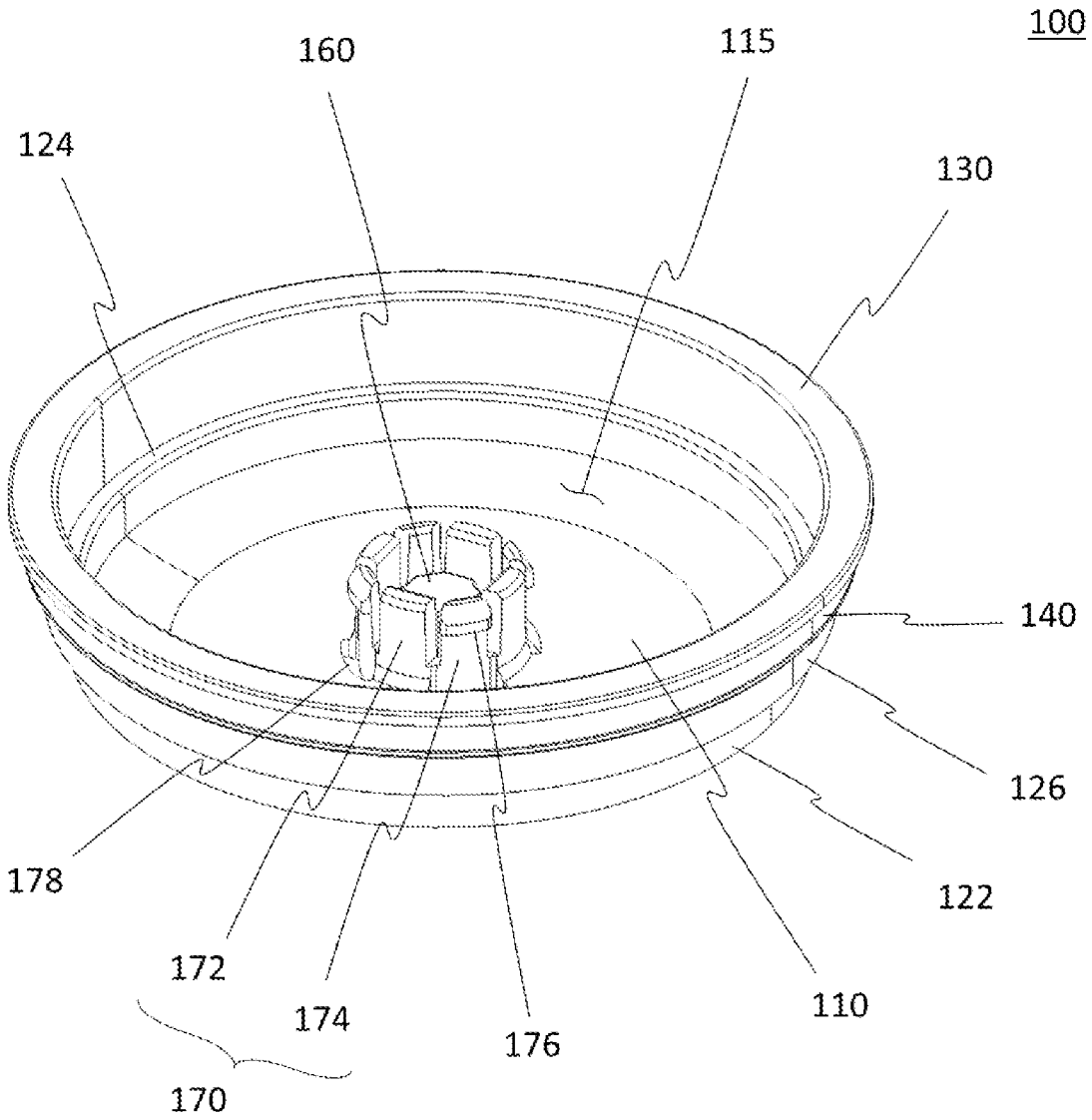
FIG. 6 is a perspective view illustrating the stationary container of a grinding compact container according to an embodiment of the invention.
Figure 7:
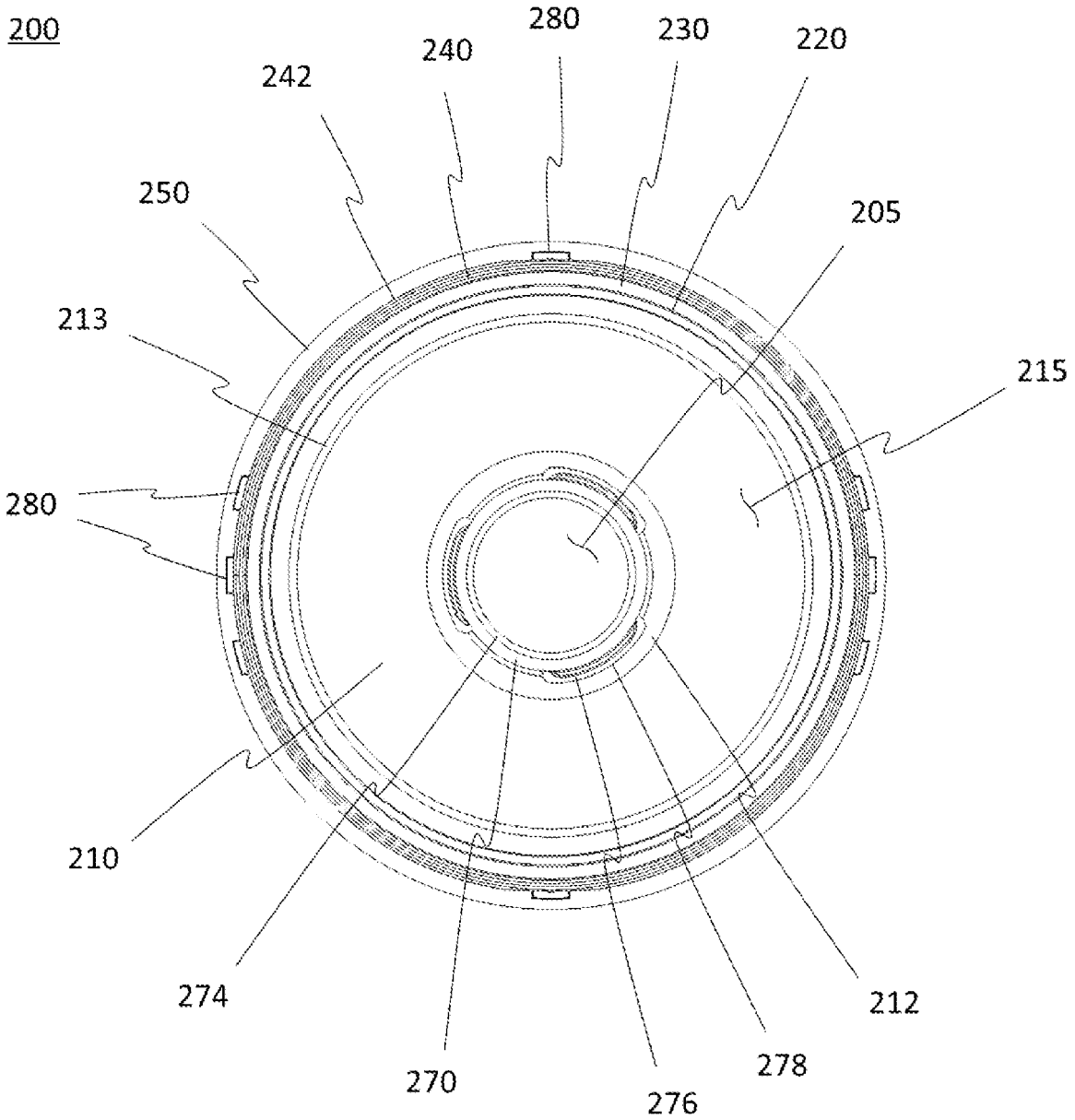
FIG. 7 is a top view illustrating the rotary container of a grinding compact container according to an embodiment of the invention.
Figure 8:
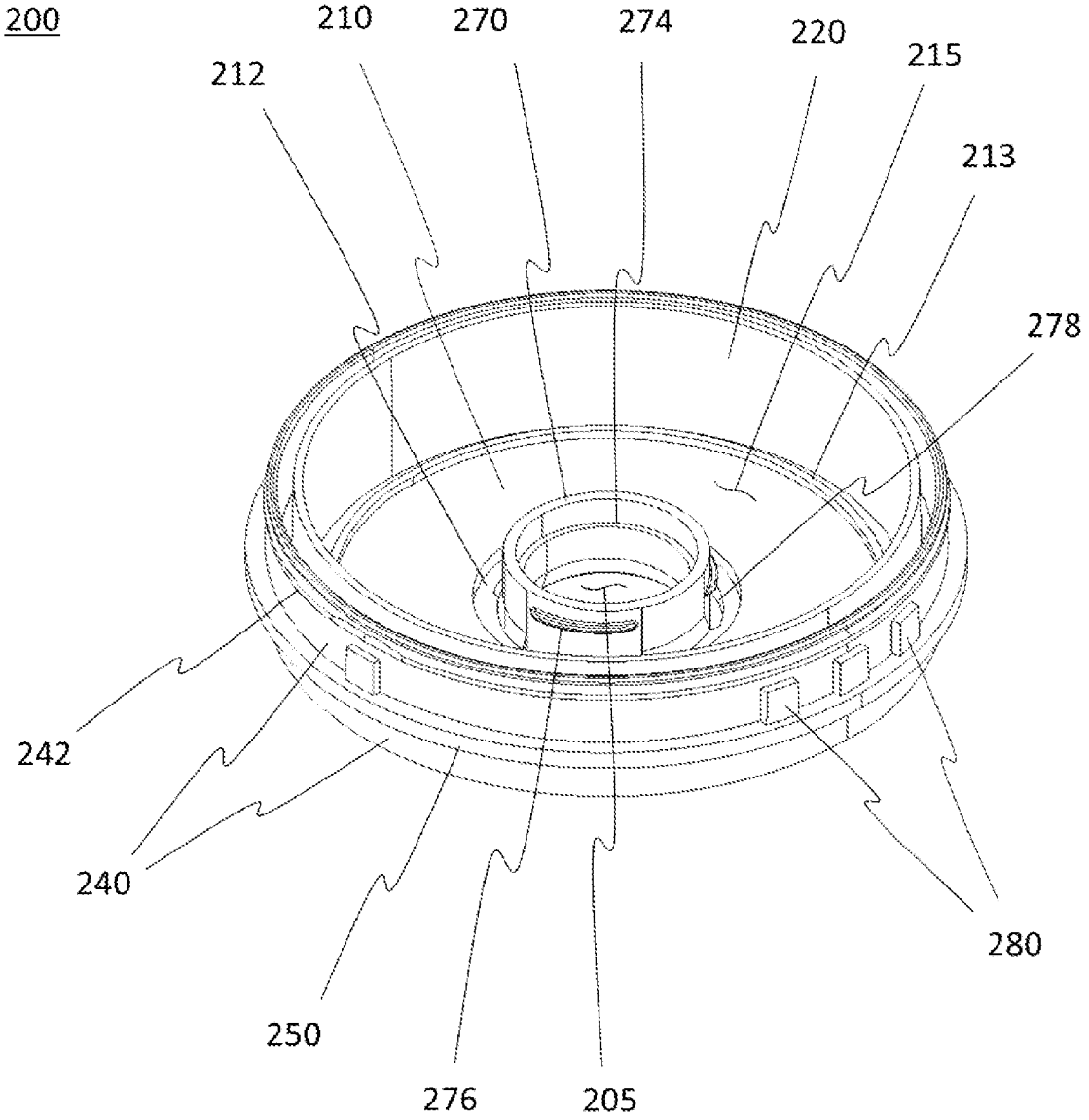
FIG. 8 is a perspective view illustrating the rotary container of a grinding compact container according to an embodiment of the invention.
Figure 9:
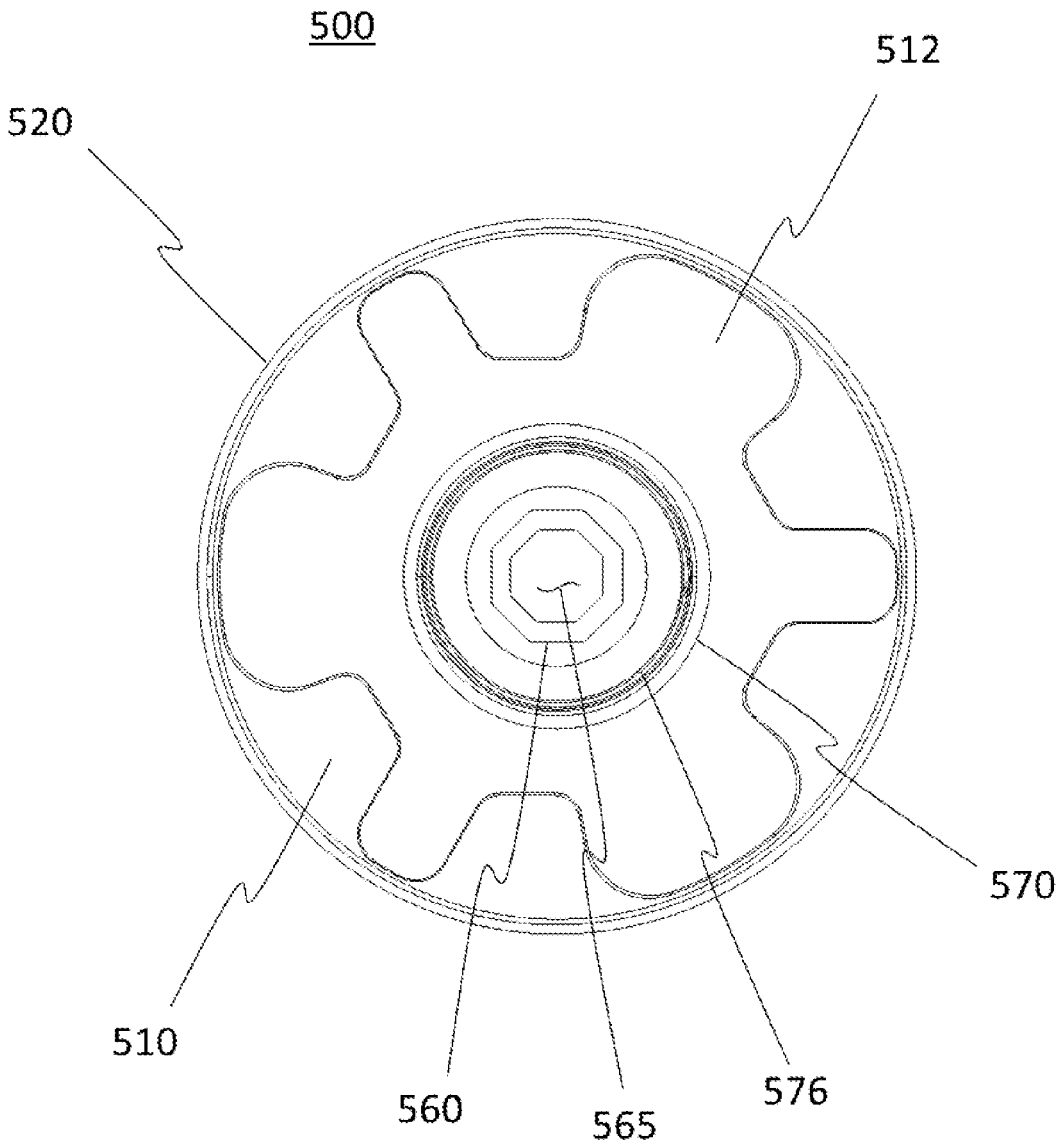
FIG. 9 is a bottom view illustrating the content holder of a grinding compact container according to an embodiment of the invention.
Figure 10:
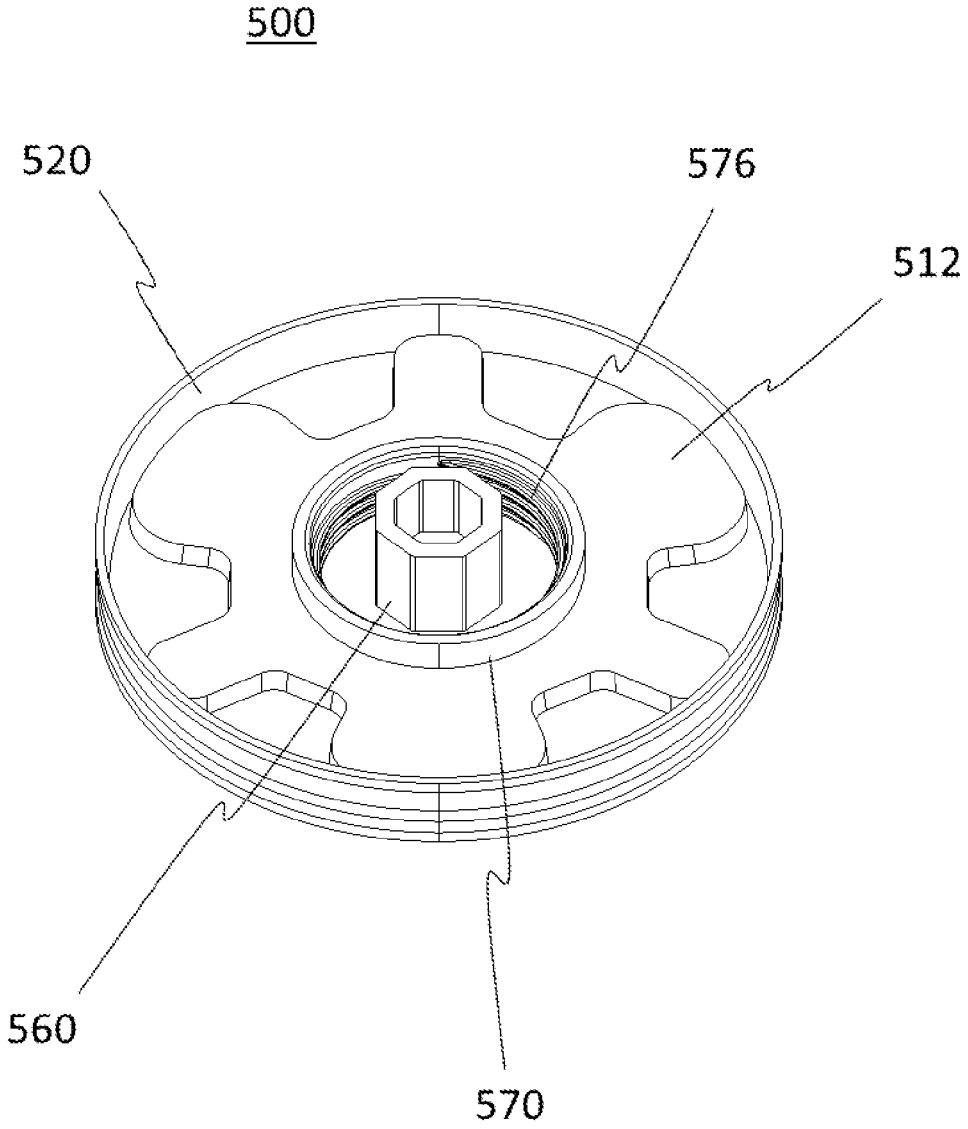
FIG. 10 is a perspective view illustrating the content holder of a grinding compact container according to an embodiment of the invention as seen from the bottom.
Figure 11:
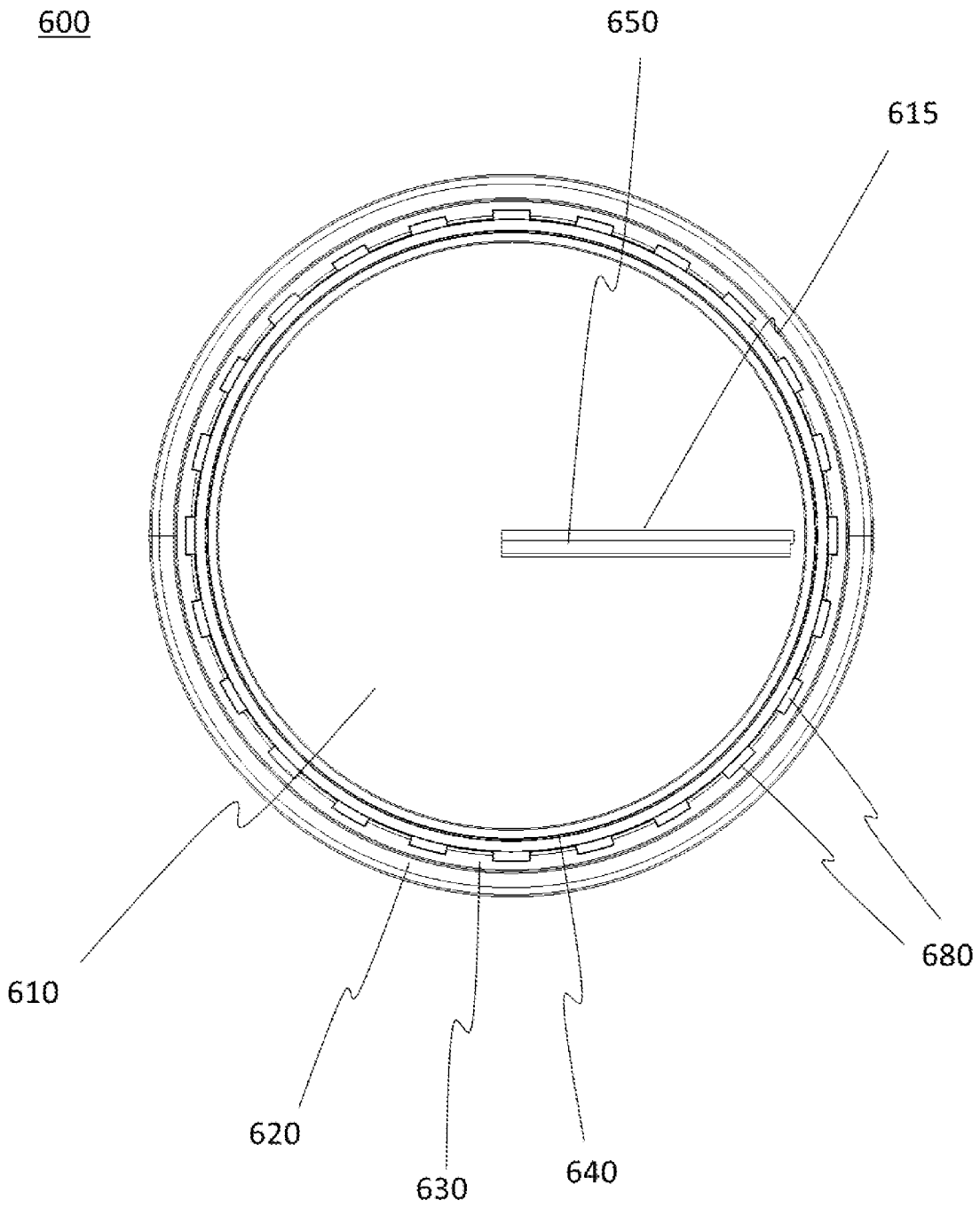
FIG. 11 is a bottom view illustrating the dial cover of a grinding compact container according to an embodiment of the invention.
Figure 12:
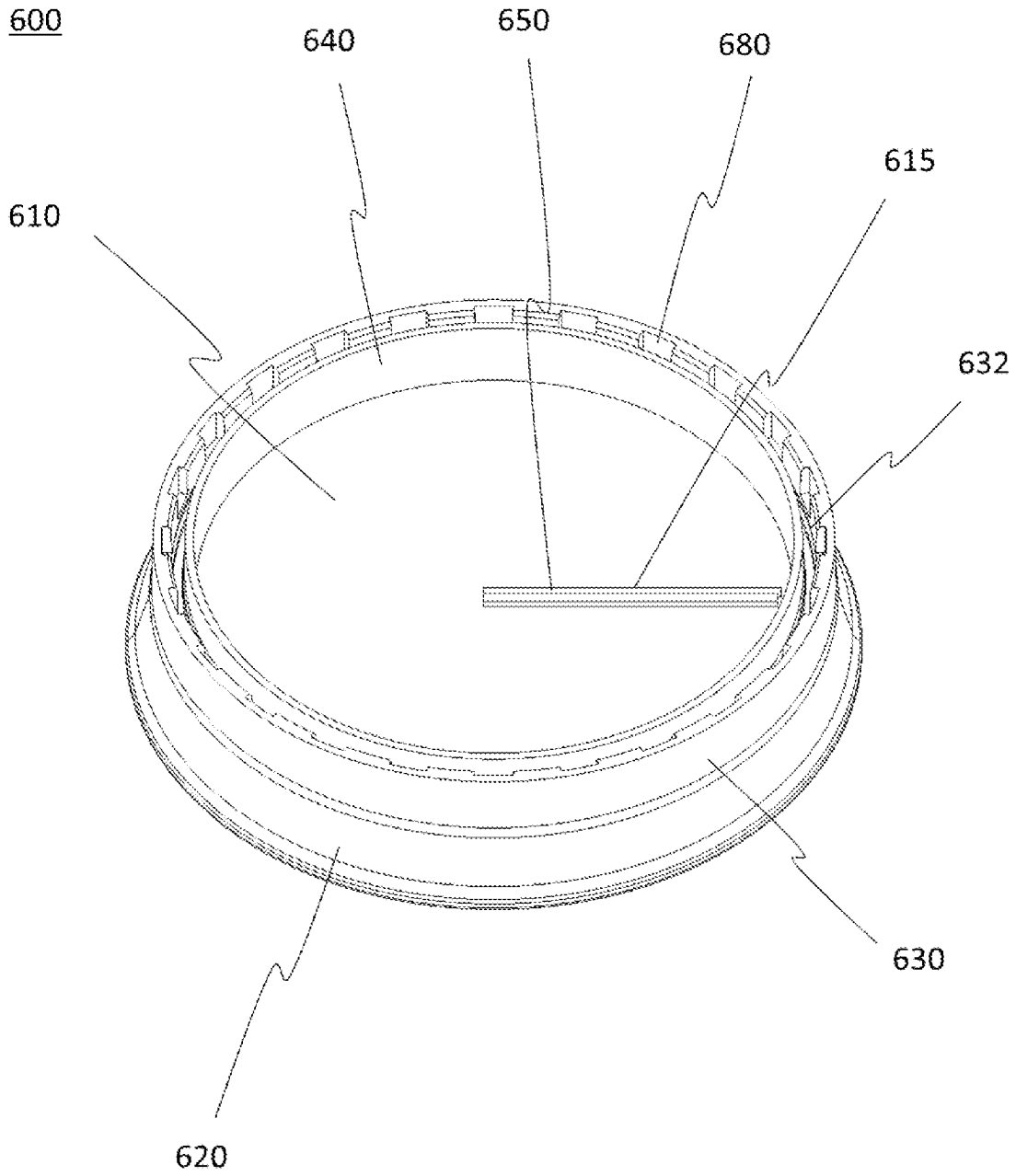
FIG. 12 is a perspective view illustrating the dial cover of a grinding compact container according to an embodiment of the invention as seen from the bottom.

FIG. 1 is a perspective view illustrating a grinding compact container 1000 according to an embodiment of the invention, and FIG. 2 is an exploded perspective view illustrating a grinding compact container 1000 according to an embodiment of the invention. FIG. 3 and FIG. 4 are cross-sectional views illustrating a grinding compact container 1000 according to an embodiment of the invention. FIGS. 5 to 12 provide a more detailed depiction of certain components of the grinding compact container 1000, where FIG. 5 and FIG. 6 illustrate the stationary container 100, FIG. 7 and FIG. 8 illustrate the rotary container 200, FIG. 9 and FIG. 10 illustrate the content holder 500, and FIG. 11 and FIG. 12 illustrate the dial cover 600. Incidentally, in all of drawings except FIG. 3, the content 10 is omitted, to allow an easier understanding of the structure of the invention.

A grinding compact container 1000 according to an embodiment of the invention may be configured to grind a solid content 10 held within, such as a compressed powder, etc., and provide the content 10 in a ground form. Although it is not illustrated in the drawings, the grinding compact container 1000 can further include an upper case (not shown) and a lower case (not shown), and the structure illustrated in the drawings can be mounted in the lower case (not shown), which may form a part of the exterior. The upper case and the lower case can be implemented in any of a wide variety of forms and can even be omitted. The structure of the remaining parts of the grinding compact container 1000 can be modified correspondingly.

Referring to FIGS. 1 to 12, a grinding compact container 1000 according to an embodiment of the invention can include a stationary container 100, a rotary container 200, an elastic member 400, a content holder 500, and a dial cover 600. As described above, the grinding compact container 1000 can also additionally include a separate upper case (not shown) and a separate lower case (not shown).

The stationary container 100 can include a base 110 and a side wall 122, 126 to form a mounting space 115 that opens upward. The rotary container 200, elastic member 400, and content holder 500 can be housed in the mounting space 115. Although it is not depicted in the drawings, the stationary container 100 can be mounted within a separate lower case (not shown) for use. Of course, it is also possible to fabricate the stationary container 100 as a structure that does not require mounting in a separate lower case (not shown).

The base 110 of the stationary container 100 can have a generally circular shape. Although it is not illustrated in the drawings, a protrusion or groove for aligning the rotary container 200 can be formed on the surface of the base 110 facing the mounting space 115. For example, a protrusion and a groove that mate with each other can be formed on the base 110 of the stationary container 100 and on a lower surface of the rotary container 200. In such a case, the protrusion can be inserted in the groove to aid the alignment of the rotary container 200. The protrusion and groove can be configured in a way that does not hinder the rotation of the rotary container 200.

The side wall 122, 126 of the stationary container 100 can be divided into a first side wall 122 and a second side wall 126, where the first side wall 122 and the second side wall 126 can have different diameters so that a ledge 124 may be formed in-between. This structure can be used for mounting and aligning the stationary container 100 with respect to the lower case (not shown) as well as for mounting and aligning the rotary container 200 with respect to the stationary container 100.

The stationary container 100 can further include a flange 130 positioned at an upper portion of the side wall 126. In cases where the stationary container 100 is inserted into a lower case (not shown) that is coupled to an upper case (not shown), the lower rim of the upper case (not shown) can rest on the flange 130 of the stationary container 100. Although it is not depicted in the drawings, in certain embodiments, clearance indentations for a hinge, button, etc., associated with a structure for opening the upper case in relation to the lower case can be formed in predetermined positions of the flange 130.

The stationary container 100 can further include an outer rim 140 that extends downward from a lower surface of the flange 130. The outer rim 140 can have a diameter larger than those of the side wall 122, 126 so as to be located on an outer side of the side wall 126. The outer rim 140 can be used for coupling and securing the stationary container 100 to the lower case (not shown). For example, the outer rim 140 can be inserted into a groove formed in the lower case (not shown), or a portion of the lower case (not shown) can be inserted into the gap between the outer rim 140 and the side wall 126.

The stationary container 100 can include a first insert-joint part that extends upward from the base 110. The first insert-joint part can engage and be coupled with a second insert-joint part formed on the content holder 500. In the example illustrated in the drawings, the first insert-joint part is implemented in the form of a protruding part 160 that extends upward, while the second insert-joint part is implemented in the form of a sleeve 560 that extends downward. The protruding part 160 and the sleeve 560 can have cross sections that are not circular in shape and can each have the same cross sections over a designed length along the longitudinal direction, so that when the protruding part 160 is inserted in the sleeve 560, the content holder 500 is able to move along the longitudinal direction but unable to rotate in relation to the stationary container 100.

In the example illustrated in the drawings, the first insert-joint part is implemented in the form of a protruding part 160, and the second insert-joint part is implemented in the form of a sleeve 560 into which the protruding part 160 is inserted. However, in certain other embodiments, the first insert-joint part can include the sleeve, and the second insert-joint part can include the protruding part. In addition, various other structures that allow the content holder 500 to move along the longitudinal direction while restricting rotation relative to the stationary container 100 can be applied as the first insert-joint part and second insert-joint part.

The stationary container 100 can include a coupling boss 170 that extends upward from the base 110. The coupling boss 170 can serve to rotatably couple the rotary container 200 and align the content holder 500 at its designated position. The cross section of the coupling boss 170 can be designed such that the outer perimeter follows a circular shape while the inner perimeter follows a polygonal shape or some other non-circular shape.

In an embodiment of the invention, the coupling boss 170 can include a multiple number of fixed members 172 and a multiple number of detent members 174. The fixed members 172 and the detent members 174 can be arranged alternatingly. Each of the fixed members 172 and detent members 174 can have a surface on the outer side shaped as an arc and a surface on the inner side shaped as a plane that is orthogonal to the base 110.

The fixed members 172 can extend upward from the base 110 and can form a part of the coupling boss 170. A fixed member 172 can have substantially the same cross section along the longitudinal direction and can maintain a fixed state. In an embodiment of the invention, the second insert-joint part (for instance, the sleeve 560) of the content holder 500 can be inserted to the inner side of the coupling boss 170, and the inner surfaces of the fixed members 172 can contact and secure the outer surface of the second insert-joint part, thereby allowing the content holder 500 to maintain an aligned state with respect to the stationary container 100.

The detent members 174 can also extend upward from the base 110 and can form a part of the coupling boss 170, but a detent protrusion 176 can be formed on an upper portion of each detent member 174. The upper portion of a detent protrusion 176 can have a sloped or curved shape, whereas the lower portion of the detent protrusion 176 can form a flat curb, which can be used in coupling the rotary container 200 to the stationary container 100. In an embodiment of the invention, as the rotary container 200 is coupled over the stationary container 100, the coupling boss 170 can be inserted to the inner side of a first screw-joint part 270 of the rotary container 200. When the rotary container 200 reaches its designed position, the detent protrusions 176 of the detent members 174 may latch onto a detent curb 274 on the inner side of the first screw-joint part 270. This structure can prevent the rotary container 200 from moving along the longitudinal direction or becoming attached from the stationary container 100 while allowing the rotary container 200 to rotate in relation to the stationary container 100.

Tolerance holes 178 can be formed in the base 110 of the stationary container 100 at positions adjacent to the detent members 174. Due to the tolerance holes 178, the lower ends of the detent members 174 are not connected to the base 110 at the outer side of the coupling boss 170, and this allows the detent members 174 to undergo elastic deformation more easily. Thus, when the coupling boss 170 is inserted to the inner side of the first screw-joint part 270 of the rotary container 200, the detent members 174 can more easily receded inward until the detent protrusions 176 reach the top of the detent curb 274, so that the rotary container 200 may be more easily coupled to the stationary container 100.

In cases where the first insert-joint part of the stationary container 100 is implemented in the form of a sleeve, the coupling boss 170 can also serve the role of the sleeve. However, in a structure in which the stationary container 100 includes a protruding part 160 and further includes a separate coupling boss 170, as is the case in the structure illustrated in the drawings, the stationary container 100 and the content holder 500 can be coupled to each other in a more stable manner. Such a structure also makes it possible to mold the content holder 500 in a simple manner without requiring an excessively deep recess in the main plate 510 of the content holder 500 and without filling in unnecessary spaces with material.

In cases where a grinding compact container 1000 according to an embodiment of the invention does not include a separate lower case and the stationary container 100 forms a part of the exterior of the grinding compact container 1000, a separate component for covering the tolerance holes 178 can additionally be included, and the detailed shapes of the side wall 122, 126, flange 130, outer rim 140, etc., can also be modified.

The rotary container 200 can be coupled in the mounting space 115 such that the rotary container 200 is able to rotate in relation to the stationary container 100. The rotary container 200 itself can form an upwardly open holding space 215 on its inner side, where the elastic member 400 and the content holder 500 can be housed in the holding space 215. That is, the rotary container 200 can be held in the mounting space 115 of the stationary container 100, while the elastic member 400 and the content holder 500 can be held in the holding space 215 of the rotary container 200. Therefore, the elastic member 400 and the content holder 500 can also be regarded as being housed within the mounting space 115.

The rotary container 200 can include a base 210 and a side wall 220 to form the holding space 215 that opens upward. The base 210 of the rotary container 200 can have a generally circular shape, corresponding to the shape of the base 110 of the stationary container 100, and can be arranged adjacent to the base 110 of the stationary container 100. A passage 205 can be formed in the center of the base 210, penetrating the base 210 along the longitudinal direction. The stationary container 100, which may be positioned under the rotary container 200, and the content holder 500, which may be positioned above the rotary container 200, can be coupled to each other through the passage 205.

A securing protrusion 213 can be formed on an upper surface of the base 210 of the rotary container 200, where the securing protrusion 213 can be used for aligning and securing the lower end of the elastic member 400. For example, the securing protrusion 213 can be formed in an annular shape, as illustrated in FIGS. 2 to 4, and the lower end of the elastic member 400 can be inserted and secured to the inner side of the securing protrusion 213. Certain embodiments can also include an additional securing protrusion on the inner side of the lower end of the elastic member 400.

The side wall 220 of the rotary container 200 can extend upward from the base 210 to form the holding space 215 on its inner side. When the content holder 500 moves along the longitudinal direction within the holding space 215, a contact part 520 provided on an outer side of the content holder 500 can maintain tight contact with the inner perimeter of the side wall 220.

The rotary container 200 can include a buffer rim 240 that is connected by a bridge 230 to the outer perimeter of the side wall 220. The buffer rim 240 can have a larger diameter than the side wall 220 of the rotary container 200 to be located on the outer side of the side wall 220. An upper portion of the buffer rim 240 can be used for coupling the rotary container 200 with the dial cover 600, and to this end, a coupling protrusion 242 can be formed on the outer perimeter or inner perimeter of the of the buffer rim 240. When the rotary container 200 and the dial cover 600 are coupled to each other, the upper portion of the buffer rim 240 can be inserted into the space between the outer rim 630 and inner rim 640 of the dial cover 600, and the coupling protrusion 242 can be inserted into a coupling indentation formed in the outer rim 630 or inner rim 640 to implement a secure coupling.

A lower portion of the buffer rim 240 can serve to buffer any impact on the main portion of the rotary container 200 from the outer side of the side wall 220. When the user uses the grinding compact container 1000, the rotary container 200 coupled to the dial cover 600 can be rotated in relation to the stationary container 100. If the side wall 220 of the rotary container 200 were to contact the side wall 122 of the stationary container 100 without any buffer when the rotary container 200 is rotated within the mounting space 115, the force of the rotation of the rotary container 200 would damage or abrade the points of contact between the stationary container 100 and the rotary container 200. Since the lower portion of the buffer rim 240 is separated by a particular distance from the side wall 220 of the rotary container 200, the buffer rim 240 may undergo a slight elastic deformation and absorb the force from the rotation of the rotary container 200 to a certain degree, whereby the extent of damage and abrasion can be reduced, compared to the case of the side wall 220 of the rotary container 200 contacting the side wall 122 of the stationary container 100 directly.

A curb flange 250 can extend outward on the outer side of the buffer rim 240. When the rotary container 200 is arranged in the mounting space 115 of the stationary container 100, the curb flange 250 can rest on the ledge 124 of the stationary container 100. This structure can help reduce friction between the base 210 of the rotary container 200 and the base 110 of the stationary container 100. Depending on how the height of the curb flange 250 is set, the base 210 of the rotary container 200 can be made not to contact the base 110 of the stationary container 100. In this case, the curb flange 250 and the ledge 124 can be configured to have a particularly low friction between each other. When the dial cover 600 is coupled to the rotary container 200, the lower end of the first lower rim 630 of the dial cover 600 can rest on the upper surface of the curb flange 250.

The rotary container 200 can include a first screw-joint part 270 that extends upward from the center of the base 210. The first screw-joint part 270 can be configured to mate with a second screw-joint part 570 formed on the content holder 500 to form a screw joint. The first screw-joint part 270 can be open both upward and downward to form the passage 205 on its inner side, where the passage 205 can enable the coupling between the stationary container 100 and the content holder 500 as described above.

In the example illustrated in the drawings, the first screw-joint part 270 includes gear protrusions 276, and the second screw-joint part 570 includes a thread 576. The gear protrusions 276 can move only along the troughs of the thread 576. Since, from the perspective of the stationary container 100, the rotary container 200 on which the gear protrusions 276 are formed undergoes relative rotation whereas the content holder 500 on which the thread 576 is formed cannot rotate, the first screw-joint part 270 and the second screw-joint part 570 may form a sort of lead screw that allows the content holder 500 to move along the longitudinal direction. The gear protrusion 276 can also be implemented in the form of a male thread or as any of a variety of structures as long as a screw joint may be formed between the first screw-joint part 270 and the second screw-joint part 570.

A detent curb 274 can be formed on the inner perimeter of the first screw-joint part 270, and when the coupling boss 170 of the stationary container 100 is inserted through the passage 205 on the inner side of the first screw-joint part 270, the rotary container 200 can be coupled to the stationary container 100 as the detent protrusions 176 of the coupling boss 170 latch onto the detent curb 274. As shown in FIG. 3 and FIG. 4, in an embodiment of the invention, the first screw-joint part 270 can be configured such that, when the rotary container 200 is coupled to the stationary container 100, the upper end of the first screw-joint part 270 is at a height corresponding to the upper end of the coupling boss 170, and the detent curb 274 is at a height corresponding to the lower surface of the detent protrusions 176 of the coupling boss 170.

As illustrated in FIG. 7, tolerance holes 278 can be formed in the base 210 of the rotary container 200 at positions adjacent to the first screw-joint part 270. Due to the tolerance holes 278, the lower end of the first screw-joint part 270 may not be secured with excessive rigidity to the base 210 of the rotary container 200, and this allows the first screw-joint part 270 to undergo elastic deformation more easily. In cases where there are no tolerance holes 278 formed, the force from the rotation of the rotary container 200 within the mounting space 115 can be transferred to the first screw-joint part 270, and there is a risk that this force may abrade the points of contact between the coupling boss 170 and the first screw-joint part 270 or even damage the first screw-joint part 270. The tolerance holes 278 formed in the base 210 of the rotary container 200 allow slight elastic deformations to occur near the first screw-joint part 270, which can absorb the force from the rotation of the rotary container 200 to some extent and can thus reduce the extent of damage and abrasion compared to the case of the tolerance holes 278 being absent.

The rotary container 200 can be coupled to the dial cover 600 and can be configured to rotate together with the dial cover 600. To this end, the dial cover 600 can be coupled so as not to rotate in relation to the rotary container 200. To prevent the relative rotation of the dial cover 600, guide keys 280 can be formed on an upper portion of the buffer rim 240, and guide indentations 680 can be formed in the dial cover 600. The guide keys 280 can protrude outwardly from the outer perimeter of the buffer rim 240 or protrude inwardly from the inner perimeter of the of the buffer rim 240, where the guide keys 280 can be formed intermittently at particular locations only without being formed over the entire outer perimeter and/or inner perimeter of the buffer rim 240. When the dial cover 600 is coupled to the rotary container 200, the guide keys 280 can be inserted in and engaged with the guide indentations 680, and these can force the rotary container 200 to rotate together with the dial cover 600.

In the example illustrated in FIG. 7, the guide keys 280 are formed in four directions, i.e., on the front, rear, left, and right, of the rotary container 200. This configuration can help both to firmly secure the rotary container 200 onto the dial cover 600 and to align the rotary container 200 in the proper orientation with respect to the dial cover 600. In certain embodiments of the invention, the number of guide keys 280 can be smaller or greater.

The elastic member 400 can be formed with a material and structure that allows elastic deformation and can be arranged in a compressed state under the content holder 500 within the holding space 215 of the rotary container 200. The elastic member 400 can thus sere to push the upper surface of the content holder 500 towards the bottom of the dial cover 600. The elasticity coefficient of the elastic member 400 can be such that provides a sufficient force by which the solid content 10, such as a compressed powder, etc., arranged on the upper surface of the content holder 500 may be ground by the cutter 650 of the dial cover 600 when the user rotates the dial cover 600.

In an embodiment of the invention, the elastic member 400 can be implemented in the form of a coil spring. The coil spring can be a typical coil spring having a cylindrical shape or, as in the example illustrated in FIGS. 2 to 4, can be a spring of a frustoconical shape. Of course, the elastic member 400 can be implemented in any of a variety of shapes as long as it can push the content holder 500 upward by way of an elastic restoring force.

In the example illustrated in FIGS. 2 to 4, the upper end of the elastic member 400 contacts a lower portion of the main plate 510 of the content holder 500, and the lower end of the elastic member 400 contacts the base 310 of the rotary container 200. As described above, a securing protrusion 213 can be formed on the base 210 of the rotary container 200 for aligning one end of the elastic member 400 and preventing the elastic member 400 from becoming detached. Similarly, a securing protrusion can be formed on a lower portion of the main plate 510 of the content holder 500 as well.

In certain embodiments not shown in the drawings, the elastic member 400 can be implemented as a coil spring of a frustoconical shape but arranged with the end having the larger diameter facing upward and the end having the smaller diameter facing downward, i.e., in an upside down orientation from the example illustrated in FIGS. 2 to 4. In this case, the elastic member 400 can be configured such that the upper end having the larger diameter pushes the rotary container 200 upward while at the same time pushing the lower portion of the contact part 520 of the rotary container 200 outward.

The content holder 500 can serve to support the solid content 10 within the holding space 215 of the rotary container 200. The content holder 500 can be pushed upward by the elastic member 400 and can be configured to gradually move upward from a low position within the holding space 215. The content holder 500 can initially be coupled to the stationary container 100 at the time of manufacture but later can be separated from the stationary container 100, as the user uses the grinding compact container 1000 and the solid content 10 is gradually expended. The content holder 500 can mainly include a main plate 510, a contact part 520, a second insert-joint part, and a second screw-joint part 570.

The main plate 510 can be generally shaped as a circular plate and may correspond to the main part supporting the content 10. As described above, the content 10 can be supplied on the main plate 510 in a solidified form such as a compressed powder, etc. In order that the content 10 may not easily be separated, a recess part 512 and protrusion parts 514 can be formed in the main plate 510, where the recess part 512 may be recessed downward, and the protrusion parts 514 may protrude upward. As FIG. 9 and FIG. 10 illustrate the bottom of the content holder 500, only the lower surface of the recess part 512 is shown.

The lower surface of the main plate 510 can be configured such that a uniform flat surface is formed around the second screw-joint part 570 formed in the center of the main plate 510, and the upper end of the elastic member 400 can be arranged at this portion. When the user uses the grinding compact container 1000, the rotary container 200 and the content holder 500 may be rotated relative to each other, and since one end of the elastic member 400 contacts the rotary container 200 and the other end contacts the content holder 500, slipping can occur at the portions where the elastic member 400 contacts the rotary container 200 and the content holder 500. Therefore, it can be advantageous to have a flat and smooth surface provided at the portions of the rotary container 200 and the content holder 500 where contact is made with the elastic member 400.

As described above, it is possible to arrange a frustoconical elastic member 400 such that the end having the larger diameter faces upward. In this case also, the portion of the content holder 500 that contacts the upper end of the elastic member 400 can be made to have a uniformly flat surface. That is, in the example shown in FIG. 9 and FIG. 10, the elastic member 400 is arranged such that the end having the smaller diameter faces upward and contacts the portion around the second screw-joint part 570, and therefore the portion around the second screw-joint part 570 is configured to be uniformly flat. However, in cases where the elastic member 400 is arranged such that the upper end of the elastic member 400 is adjacent to the contact part 520, the portion on the inner side of the can be made uniformly flat.

In certain embodiments, the recess part 512 can be formed at a position slightly separated from the edge of the main plate 510, so that a slight gap may be formed between the recess part 512 and the contact part 520 at the lower surface of the main plate 510, and the upper end of the elastic member 400 can be inserted and secured in this gap between the recess part 512 and the contact part 520.

The contact part 520 can be located at an outer side of the main plate 510 and can be connected to the main plate 510 by a relatively thin connecting part. The contact part 520 can extend upward and downward and can be formed in a thickness that renders a slight amount of flexibility. Thus, the contact part 520 can tightly contact the side wall 220 of the rotary container 200 in a comparatively airtight manner, to minimize any leakage of the content 10 below the content holder 500.

The second insert-joint part can extend downward from a lower surface of the main plate 510 and can engage and be coupled with the first insert-joint part of the stationary container 100 through the passage 205 formed in the rotary container 200. In the example illustrated in the drawings, the second insert-joint part is implemented in the form of a downwardly extending sleeve 560. The protruding part 160 of the stationary container 100 and the sleeve 560 of the content holder 500 can have cross sections that are not circular in shape but can each have the same cross section over a designed length along the longitudinal direction, so that when the protruding part 160 is inserted in the sleeve 560, the content holder 500 is able to move along the longitudinal direction but unable to rotate in relation to the stationary container 100. Of course, as described above, any of a variety of structures that permit the relative movement of the content holder 500 along the longitudinal direction but restricts the rotation of the content holder 500 relative to the stationary container 100 can be employed for the first insert-joint part and second insert-joint part.

The sleeve 560 of the content holder 500 can be inserted to the inner side of the coupling boss 170. That is, when the content holder 500 is coupled to the stationary container 100, the protruding part 160 can be inserted into the sleeve 560, and the sleeve 560 can be inserted into the space between the protruding part 160 and the coupling boss 170. This structure allows a more stable coupling for the stationary container 100 and the content holder 500 and also makes it possible to mold the content holder 500 in a simple manner without requiring an excessively deep recess in the main plate 510 of the content holder 500 and without filling in unnecessary spaces with material.

In an embodiment of the invention, the lengths of the coupling boss 170 and the sleeve 560 can be designed to be greater than the distance between the upper surface of the content holder 500 and the lower surface of the dial cover 600. Thus, even when the content 10 on the upper surface of the content holder 500 is completely depleted and the content holder 500 reaches the highest point of its movable range, a portion of the sleeve 560 can remain on the inner side of the coupling boss 170, and the content holder 500 can thus maintain a stably supported position.

The second screw-joint part 570 can extend downward from the main plate 510 and can mate with the first screw-joint part 270 of the rotary container 200 to form a screw joint. The second screw-joint part 570 can be formed as a cylinder that is empty on its inner side, where the empty space on the inner side can be open downward, and the first screw-joint part 270 can be inserted into this space.

In the example illustrated in the drawings, the first screw-joint part 270 includes gear protrusions 276, and the second screw-joint part 570 includes a thread 576. As described above, the gear protrusions 276 and the thread 576 can function as a lead screw so as to allow the content holder 500 to move along the longitudinal direction. Although the first screw-joint part 270 includes the gear protrusions 276 and the second screw-joint part 570 includes the thread 576 with which the gear protrusions 276 mate in the example illustrated in the drawings, it is possible to have the first screw-joint part 270 include the thread and the second screw-joint part 570 include the gear protrusions in other embodiments.

In an embodiment of the invention, the length of the thread 576 can be designed to be smaller than the distance between the upper surface of the content holder 500 and the lower surface of the dial cover 600. Thus, as the content 10 on the upper surface of the content holder 500 is depleted and the content holder 500 is gradually moved upward, at some point the gear protrusions 276 can be moved beyond the thread 576, and the screw joint between the first screw-joint part 270 and the second screw-joint part 570 can be disengaged.

The dial cover 600 can be coupled to an upper portion of the rotary container 200 and can serve to cover the holding space 215 in which the content 10 is held, grind the content 10 with a cutter 650, and provide the ground content 10 to the user. The dial cover 600 can be coupled to the upper portion of the rotary container 200 such that it is unable to rotate relative to the rotary container 200. Therefore, when the user rotates the dial cover 600, the rotary container 200 coupled to the dial cover 600 can be rotated together. The dial cover 600 can mainly include a cover part 610, a grip part 620, an outer rim 630, an inner rim 640, and a cutter 650.

The cover part 610 can be generally shaped as a circular plate and can be configured to cover the open top of the holding space 215 of the rotary container 200. One or more dispensing hole 615 can be formed in the cover part 610, where the dispensing hole 615 may be a passage through which the ground content 10 may be dispensed. Although the dispensing hole 615 is formed in a linear shape in the example illustrated in the drawings, the dispensing hole 615 can be formed in any of a variety of shapes.

The grip part 620 can extend upward from the edge of the cover part 610. As illustrated in FIGS. 1 to 4, the grip part 620 can have a curved shape that widens outward. In cases where a grinding compact container 1000 according to an embodiment of the invention includes an upper case and a lower case, the cover part 610 and the grip part 620 can form a space under the upper case for keeping a powder puff, etc. The curved shape of the grip part 620 can not only provide an exterior appearance suitable for holding a puff but can also eliminate edges where the powder of the content 10 may otherwise accumulate, so that a clean surface may be maintained.

The outer rim 630 and the inner rim 640 can extend downward from a lower surface of the cover part 610, where the outer rim 630 can be located at the edge of the cover part 610, and the inner rim 640 can be formed with a smaller diameter than the outer rim 630 to be located on an inner side of the outer rim 630. When the dial cover 600 is coupled to the rotary container 200, the upper portion of the buffer rim 240 of the rotary container 200 can be inserted into the gap between the outer rim 630 and inner rim 640 of the dial cover 600, and the inner rim 640 of the dial cover 600 can be inserted into the gap between the side wall 220 and buffer rim 240 of the rotary container 200. In the outer rim 630 and/or the inner rim 640, a coupling groove can be formed into which the coupling protrusion 242 of the rotary container 200 may be inserted. The coupling protrusion 242 inserted in the coupling groove can prevent the dial cover 600 from becoming detached from the rotary container 200 along the longitudinal direction.

As shown in FIG. 11 and FIG. 12, which illustrate the bottom of the dial cover 600, guide indentations 680 can be formed in the outer rim 630 and/or the inner rim 640. In the example illustrated in the drawings, a multiple number of guide indentations 680 are formed in equal sizes and in constant intervals. Of course, in certain embodiments, the guide indentations 680 can be formed only in designated locations corresponding to the guide keys 280. In certain embodiments, the guide keys can be formed on the dial cover 600, and the guide indentations can be formed in the rotary container 200. In such cases, modifications can be made to the structure for coupling the dial cover 600 and the rotary container 200.

When the dial cover 600 is coupled to the rotary container 200, the guide keys 280 of the rotary container 200 can be inserted into guide indentations 680 formed in the corresponding locations, and since the guide keys 280 are not formed continuously over the entire inner perimeter and/or outer perimeter of the buffer rim 240, the mating of the guide keys 280 and guide indentations 680 prevent the rotary container 200 from rotating in relation to the dial cover 600. Therefore, when the user rotates the dial cover 600, the rotary container 200 coupled to the dial cover 600 may rotate together.

The cutter 650 can be formed on the lower surface of the cover part 610 at a position adjacent to the dispensing hole 615, so that the content 10 ground by the cutter 650 may immediately pass through the dispensing hole 615. The cutter 650 can have a shape corresponding to that of the dispensing hole 615, and the length of the cutter 650 can be the same as or somewhat smaller than the length of the dispensing hole 615. The cutter 650 can be made from a material of a sufficient strength for easily grinding the content 10.

A more detailed description is provided below, with reference to FIGS. 2 to 12, of a process for assembling a grinding compact container 1000 according to an embodiment of the invention.

After each component of the grinding compact container 1000 is fabricated, the rotary container 200 can be mounted in the mounting space 115 of the stationary container 100. Here, the coupling boss 170 can be inserted through the passage 205 on the inner side of the first screw-joint part 270, and as the detent protrusions 176 of the detent members 174 press against the inner perimeter of the first screw-joint part 270, the detent members 174 can slightly recede inward. When the rotary container 200 has moved down to its designated position, the detent protrusions 176 can be positioned over the detent curb 274, so that the detent members 174 may return to their original positions. The detent protrusions 176 may thus latch onto the detent curb 274, and as a result, the rotary container 200 can be rotatably secured to the stationary container 100.

Then, the elastic member 400 and the content holder 500, as well as the solid content 10 arranged on the content holder 500, can be mounted in the holding space 215 of the rotary container 200. With the elastic member 400 arranged in-between, the content holder 500 can be lowered within the holding space 215 towards the base 210 of the rotary container 200. As the content holder 500 is lowered, the elastic member 400 can be increasingly more compressed. During the lowering of the content holder 500, the protruding part 160 can be inserted to the inner side of the sleeve 560, and the sleeve 560 can be inserted to the inner side of the coupling boss 170. Once the gear protrusions 276 of the first screw-joint part 270 meet the thread 576 of the second screw-joint part 570, the rotary container 200 can be rotated in place as the gear protrusions 276 move along the thread 576. The screw joint formed by the first screw-joint part 270 and second screw-joint part 570 can resist the force applied by the elastic member 400.

The solid content 10 can be supplied before the content holder 500 is mounted in the holding space 215 or can be supplied after the content holder 500 is disposed at its designated position at a lower portion of the holding space 215. The solid content 10 can be a compressed powder for a cosmetic such as a foundation, etc., but the invention is not limited by the type of content 10.

After the content holder 500 is installed at the designated position, the dial cover 600 can be coupled to the rotary container 200. The dial cover 600 can first be oriented such that the guide keys 280 are aligned with the guide indentations 680 and, while in this state, can be coupled to the upper portion of the rotary container 200. When the dial cover 600 is moved down and the coupling protrusion 242 of the rotary container 200 is inserted in the coupling groove of the dial cover 600, the coupling protrusion 242 inserted in the coupling groove can secure the dial cover 600 with respect to the rotary container 200 along the longitudinal direction, and the guide keys 280 inserted in the guide indentations 680 can secure the dial cover 600 along the direction of rotation.

Once the dial cover 600 is coupled as above, the grinding compact container 1000 can be in an assembled state, as illustrated in FIG. 3. As already described above, the structure illustrated in FIG. 3 can also be mounted in a separate upper case (not shown) and lower case (not shown).

A more detailed description is provided below, with reference to FIGS. 2 to 12, of a process for using a grinding compact container 1000 according to an embodiment of the invention.

In cases where an upper case (not shown) is provided, the user may first open the upper case (not shown) to expose the dial cover 600. The user can lift the puff (not shown) resting on the cover part 610 of the dial cover 600.

The user may then hold the grip part 620 and rotate the dial cover 600. The grip part 620 forming the edge of the dial cover 600 allows the user to easily grip and rotate the dial cover 600. When the grinding compact container 1000 is used for the first time, the first screw-joint part 270 of the rotary container 200 and the second screw-joint part 570 of the content holder 500 may form a screw joint and may be in a secured state, as illustrated in FIG. 3. When the user rotates the dial cover 600 from this state, the rotation of the dial cover 600 may be transferred to the rotary container 200, so that the rotary container 200 may rotate together. However, the content holder 500 may remain unrotated due to the coupling between the first insert-joint part (which may include, for instance, a protruding part 160) and the second insert-joint part (which may include, for instance, a sleeve 560). Consequently, the rotation of the rotary container 200 may cause movement in the first screw-joint part 270 and second screw-joint part 570 in the manner of a lead screw, and the content holder 500 may move up along the coupling boss 170.

As the content holder 500 is moved up, the solid content 10 on the content holder 500 may touch the cutter 650 on the bottom of the dial cover 600. Since the dial cover 600 and the cutter 650 are rotated whereas the content holder 500 and the content 10 are not rotated, an upper portion of the content 10 may be scraped off by the cutter 650 to be separated as powder, and the separated powder may pass through the dispensing hole 615 adjacent to the cutter 650 and be provided on the upper surface of the cover part 610. The user can then use the powder on the upper surface of the cover part 610 by using the puff held in the user's hand.

When the user rotates the dial cover 600, the tolerance holes 178 of the stationary container 100, the buffer rim 240 and tolerance hole 278 of the rotary container 200, and the contact part 520 of the content holder 500 can provide a certain degree of flexibility at the points of contact between the parts of the grinding compact container 1000, such that the parts are not excessively rigid at these points of contact, and this can help reduce damage and abrasion in the components of the grinding compact container 1000. When the content holder 500 is moved upward within the holding space 215, the contact part 520 of the content holder 500 can maintain tight contact with the side wall 220 of the rotary container 200 so as to prevent the content 10 from falling below the content holder 500.

The elastic member 400 may continuously push the content holder 500 and the content 10 upward, since the elastic member 400 was mounted in an already compressed state at the time of assembly of the grinding compact container 1000. Thus, unlike the grinding compact containers found in prior art, the user's action of rotating the dial cover 600 does not require a force for lifting up the content holder 500 and content 10 and requires only the force for scraping the surface of the content 10 with the cutter 650. As rotating the dial cover 600 does not entail a weighty sensation, the user can be provided with a smoother and more comfortable tactile sensation. Moreover, the curb flange 250 of the rotary container 200 can be placed on the ledge 124 of the stationary container 100 to reduce friction between the stationary container 100 and the rotary container 200, further allowing the user to rotate the dial cover 600 without exerting a large force.

The length of the thread 576 can be designed to be smaller than the distance between the upper surface of the content holder 500 and the lower surface of the dial cover 600. Therefore, as the content 10 is expended and the content holder 500 is moved to gradually higher positions, at some point the gear protrusions 276 may be removed from the thread 576, and the screw joint between the first screw-joint part 270 and the second screw-joint part 570 can be disengaged. From this point onward, the upward movement of the content holder 500 may no longer depend on the screw movement between the first screw-joint part 270 and second screw-joint part 570 and may depend solely on the elastic restoring force of the elastic member 400. When the content 10 on the content holder 500 is completely depleted, the content holder 500 may contact the dial cover 600 as illustrated in FIG. 4.

The length of the thread 576 with respect to the longitudinal direction can be selected from a wide range of values. The length of the thread 576 can be configured such that the first screw-joint part 270 and second screw-joint part 570 maintain the screw joint in a relatively small section within the total movable range of the content holder 500, so that the content holder 500 may be moved up by the elastic member 400 in most of the movable range.

When the content holder 500 is at its lowest position, it may be advantageous, in terms of convenient assembly of the grinding compact container 1000, to have the content holder 500 restrained. Moreover, since the elastic member 400 is at its most compressed state, it may be advantageous to somewhat limit the elastic force of the elastic member 400. After the content holder 500 has been raised to a particular height, the first screw-joint part 270 and the second screw-joint part 570 may be disengaged from each other, and as a result, the amount of upward movement by the content holder 500 may no longer be proportional to the degree of rotation of the dial cover 600. Having the content holder 500 and content 10 pushed only by the elastic member 400 in this manner can resolve the problem of the dial cover 600 becoming detached from the rotary container by an excessive force being applied on the content holder 500 and content 10. When an excessive force is applied, the elastic member 400 may conversely absorb some of the applied force.

In a preferred embodiment of the invention, the spring coefficient of the elastic member 400, the coupling force between the dial cover 600 and the rotary container 200, the consistency of the content 10, etc., can be designed such that the elastic member 400 applies a sufficient force without separating the dial cover 600 until the content holder 500 reaches the highest position within its movable range and also such that, even if the top of the content 10 is not ground uniformly, the top of the content 10 is flattened out by the force of the elastic member 400 as the top of the content 10 touches the lower surface of the cover part 610.

Figure 13:
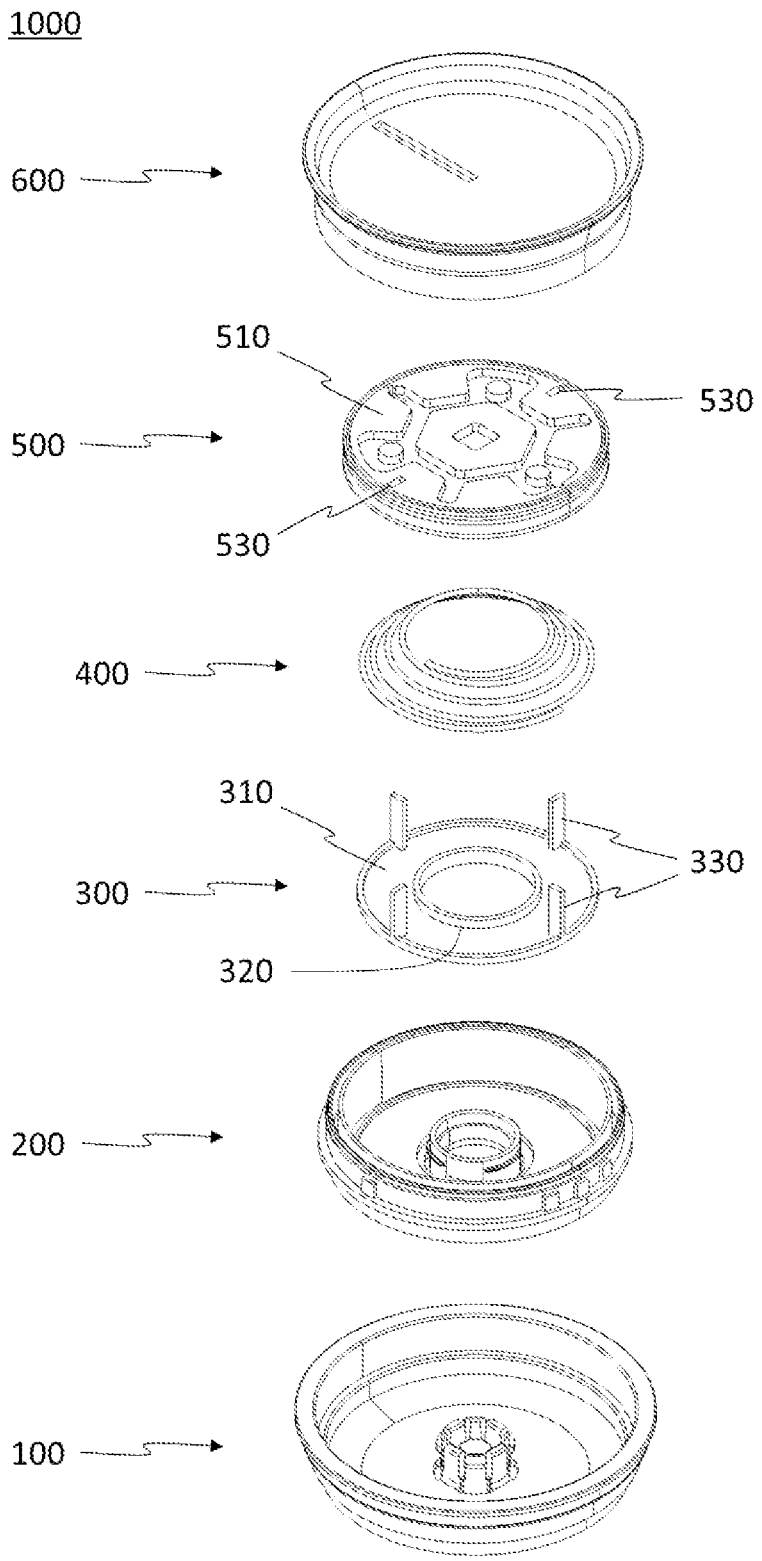
FIG. 13 is an exploded perspective view illustrating a grinding compact container according to another embodiment of the invention.
Figure 14:
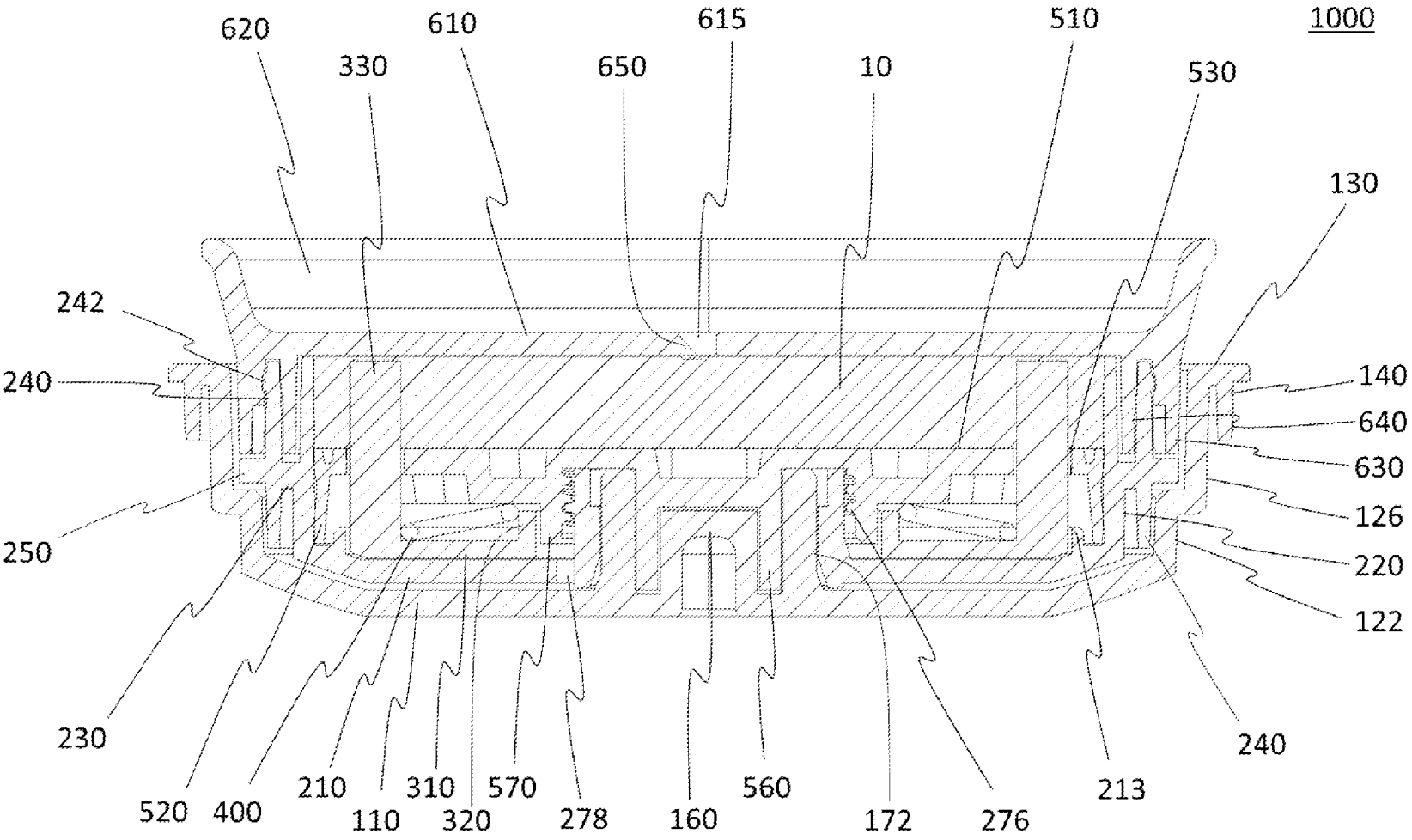
FIG. 14 is a cross-sectional view illustrating a grinding compact container according to an embodiment of the invention.
Figure 15:
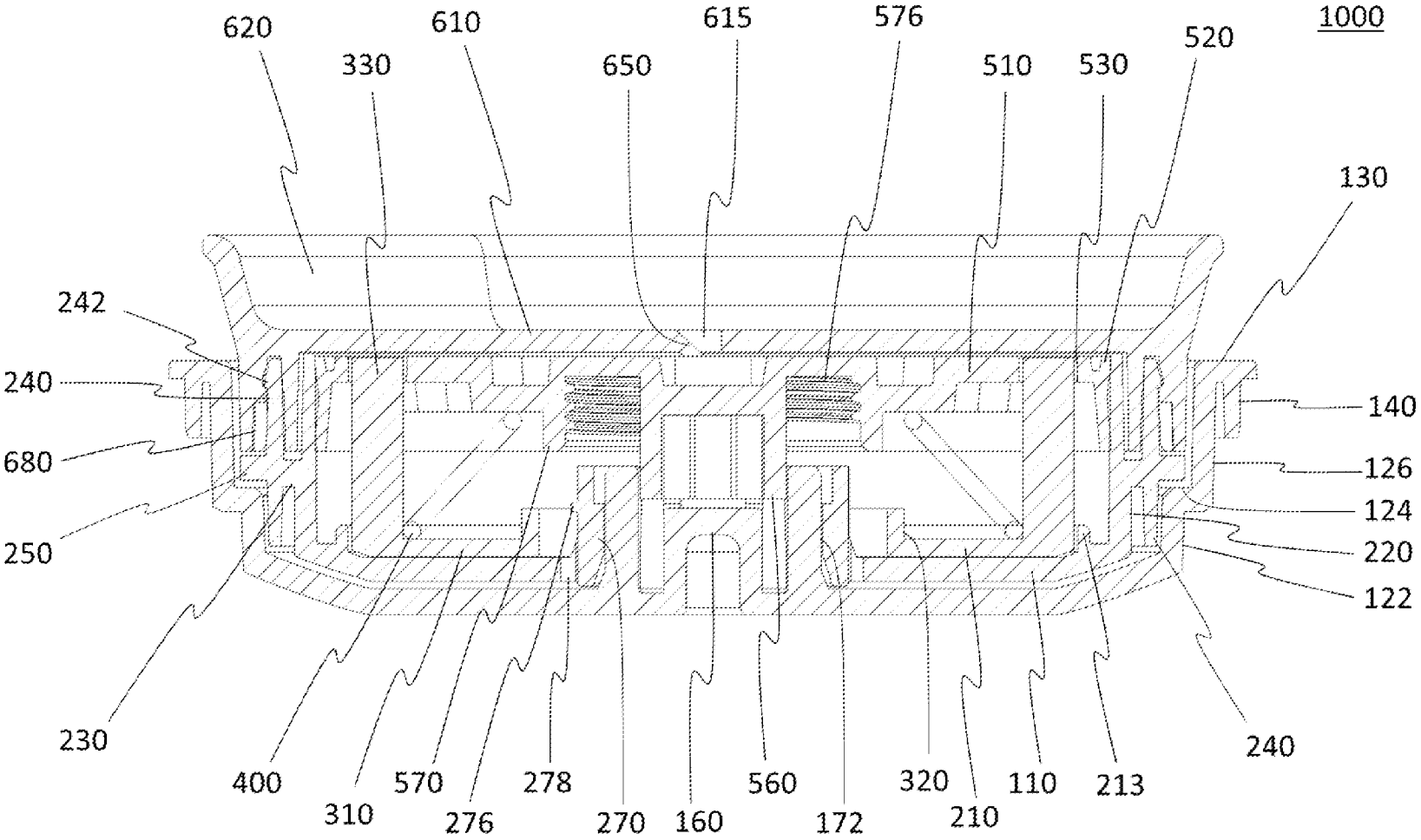
FIG. 15 is a cross-sectional view illustrating a grinding compact container according to an embodiment of the invention.

FIG. 13 is an exploded perspective view illustrating a grinding compact container 1000 according to another embodiment of the invention, and FIG. 14 and FIG. 15 are cross-sectional views illustrating the grinding compact container 1000 shown in FIG. 13.

Referring to FIGS. 13 to 15, a grinding compact container 1000 according to an embodiment of the invention can further include a holder guide 300.

The holder guide 300 can be arranged within the holding space 215 of the rotary container 200 and can aid in the securing of the content holder 500 and the solid content 10 held thereon. The holder guide 300 can be placed on the inner side of the securing protrusion 213 formed in the rotary container 200. Of course, the position of the securing protrusion 213 can be designed in accordance with the size of the holder guide 300. The holder guide 300 can mainly include a disk part 310, an annular protrusion 320, and guide columns 330.

The disk part 310 can be generally shaped as a circular plate, and a hole can be formed in the center of the disk part 310 through which the coupling boss 170, first screw-joint part 270, second screw-joint part 570, etc., may pass.

The annular protrusion 320 can protrude upward while forming an annular shape around the hole. The annular protrusion 320 can be used for aligning the second screw-joint part 570 and the elastic member 400 at their designated positions.

The guide columns 330 can extend upward from the disk part 310 along the longitudinal direction. The guide columns 330 can extend to the highest point of the holding space 215 to a position adjacent to the cover part 610 of the dial cover 600 but can also be configured not to touch the cutter 650, so that the guide columns 330 do not inhibit the rotation of the dial cover 600.

In an embodiment of the invention, the holder guide 300 can include one or more guide columns 330, and the guide columns 330 can have flat shapes. The guide columns 330 can help in preventing the content holder 500 and content 10 from rotating. As illustrated in FIG. 13, each guide column 330 can be arranged such that its inner side faces the center of the hole in the holder guide 300, so that a relatively wide surface of the guide column 330 may face a direction that resists rotation.

In cases where a grinding compact container 1000 according to an embodiment of the invention includes a holder guide 300, slits 530 can be formed in the solid content 10 and the content holder 500. The slits 530 can have shapes corresponding to the cross sections of the guide columns 330, and the content holder 500 can be arranged over the holder guide 300 such that the guide columns 330 pass through the slits 530, as illustrated in FIG. 14 and FIG. 15.

A more detailed description is provided below, with reference to FIGS. 13 to 15, of a process for assembling a grinding compact container 1000 that includes a holder guide 300. However, much of the assembly process is substantially the same as the assembly process described above for a grinding compact container 1000 that does not include a holder guide 300, and as such the descriptions below will mainly focus on the differences.

After each component of the grinding compact container 1000 is fabricated, the rotary container 200 can be mounted in the mounting space 115 of the stationary container 100 as already described above. Then, the holder guide 300 can be mounted on the inner side of the securing protrusion 213 within the holding space 215 of the rotary container 200. When the holder guide 300 is arranged at its designated position, the coupling boss 170 of the stationary container 100 and the first screw-joint part 270 of the rotary container 200 can be located on the inner side of the hole formed in the center of the holder guide 300.

Next, the elastic member 400 and the content holder 500, as well as the solid content 10 arranged on the content holder 500, can be mounted in the holding space 215 of the rotary container 200. The elastic member 400 can be arranged on the inner side of the guide columns 330 of the holder guide 300 and secured at its designated position. In cases where the elastic member 400 is a frustoconical coil spring and is arranged such that the end having the larger diameter is positioned at the bottom, as is the case in FIG. 14 and FIG. 15, the lower end of the elastic member 400 can contact the portion where guide columns 330 are connected with the disk part 310 of the holder guide 300, while the upper end of the elastic member 400 can contact the outer perimeter of the first screw-joint part 270 or second screw-joint part 570. In cases where the elastic member 400 is a frustoconical coil spring and is arranged such that the end having the larger diameter is positioned at the top, the lower end of the elastic member 400 can contact the outer perimeter of the annular protrusion 320, while the upper end of the elastic member 400 can contact the inner sides of the guide columns 330.

With the elastic member 400 arranged in-between, the content holder 500 can be lowered within the holding space 215 towards the disk part 310 of the holder guide 300. Here, the content holder 500 can be lowered such that the guide columns 330 pass through the slits 530. As the content holder 500 is lowered, the elastic member 400 can be increasingly more compressed. During the lowering of the content holder 500, the protruding part 160 can be inserted to the inner side of the sleeve 560, and the sleeve 560 can be inserted to the inner side of the coupling boss 170. Once the gear protrusions 276 of the first screw-joint part 270 meet the thread 576 of the second screw-joint part 570, the rotary container 200 can be rotated in place as the gear protrusions 276 move along the thread 576. The screw joint formed by the first screw-joint part 270 and second screw-joint part 570 can resist the force applied by the elastic member 400.

In cases where the coupling boss 170 is composed of a multiple number of fixed members 172 and a multiple number of detent members 174 as described above, when a large part of the content 10 is expended and the content holder 500 has reached a relatively high position, the coupling between the first insert-joint part (which may include, for instance, a protruding part 160) and the second insert-joint part (which may include, for instance, a sleeve 560) can be disengaged, and the coupling boss 170 may be limited in its capability of securing the sleeve 560. Under such circumstances, with a grinding compact container 1000 that does not include a holder guide 300, the user's rotating of the dial cover 600 can result in an unintended rotating of the content holder 500 and content 10 due to the friction between the cover part 610 and the content 10, so that the grinding compact container 1000 may be unable to grind the content 10.

However, if the grinding compact container 1000 does include a holder guide 300, the holder guide 300 can better suppress the rotation of the content holder 500. Thus, together with the coupling between the coupling boss 170 and the sleeve 560, the holder guide 300 can prevent the rotation of the content holder 500 and content 10.

In this way, a grinding compact container 1000 according to an embodiment of the invention can provide the user with a comfortable feel and reduce the force required for rotating the dial cover 600 by using a structure that reduces friction between the stationary container 100 and the rotary container 200 and by using an elastic member 400 that pushes the content holder 500 upward.

A grinding compact container 1000 according to an embodiment of the invention can also prevent the problem of the dial cover 600 being detached by the application of an excessive force, since an elastic member 400 is used to move the content holder 500 upward.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A grinding compact container comprising:

a stationary container having a mounting space, the mounting space being upwardly open on an inner side of the stationary container;

a rotary container having a holding space, the holding space being upwardly open on an inner side of the rotary container, the rotary container coupled to the mounting space and configured to be rotatable in relation to the stationary container;

a content holder disposed in the holding space and configured to support a solid content on an upper surface thereof, the content holder coupled to the stationary container and configured to be movable along a longitudinal direction in relation to the stationary container and non-rotatable in relation to the stationary container;

a dial cover having a cutter to grind the solid content disposed on a lower surface thereof and having a dispensing hole defined therein, the dispensing hole penetrating the dial cover along the longitudinal direction to allow dispensing of the solid content, the dial cover coupled to an upper portion of the rotary container and configured to be non-rotatable in relation to the rotary container; and an elastic member disposed as a compressed state in the holding space under the content holder to push the upper surface of the content holder towards the dial cover.

2. The grinding compact container of claim 1, wherein the rotary container has a passage defined in a center thereof, the stationary container comprises a first insert-joint part extending upward through the passage, the content holder comprises a second insert-joint part extending downward from a lower surface thereof, one of the first insert-joint part and the second insert-joint part comprises a sleeve having a space defined on an inner side thereof, another of the first insert-joint part and the second insert-joint part comprises a protruding part inserted to the inner side of the sleeve, and the protruding part has a non-circular cross section to prevent the content holder from rotating in relation to the stationary container but permit the content holder to move along the longitudinal direction in relation to the stationary container.

3. The grinding compact container of claim 1, wherein the rotary container comprises a first screw-joint part extending upward, the content holder comprises a second screw-joint part extending downward, one of the first screw-joint part and the second screw-joint part comprises a thread, and another of the first screw-joint part and the second screw-joint part comprises a gear protrusion engaged with the thread.

4. The grinding compact container of claim 3, wherein a length of the thread along the longitudinal direction is smaller than a distance between the upper surface of the content holder and the lower surface of the dial cover.

5. The grinding compact container of claim 3, wherein the first screw-joint part has a passage defined on an inner side thereof, the passage opens upward and downward, and the stationary container comprises a coupling boss extending upward to be inserted through the passage.

6. The grinding compact container of claim 5, wherein the coupling boss comprises a plurality of detent members, and each of the plurality of detent members has a detent protrusion defined on an outer side thereof.

7. The grinding compact container of claim 6, wherein the stationary container has a tolerance hole defined therein at a location adjacent to each of the plurality of detent members.

8. The grinding compact container of claim 6, wherein the coupling boss further comprises a plurality of fixed members, and the plurality of fixed members and the plurality of detent members are arranged alternately.

9. The grinding compact container of claim 1, wherein the elastic member is a coil spring having one end thereof along the longitudinal direction with a larger diameter than an opposite end thereof to have a frustoconical shape.

10. The grinding compact container of claim 9, wherein the content holder comprises a contact part configured to contact a side wall of the rotary container, and the one end of the elastic member having the larger diameter contacts an inner perimeter of the contact part, and the elastic member pushes the rotary container upward and pushes the contact part outward.

11. The grinding compact container of claim 1, further comprising a holder guide disposed in the holding space, the holder guide comprising a guide column extending along the longitudinal direction, wherein a slit is defined in the content holder, and when the content holder is arranged over the holder guide, the guide column penetrates through the slit.

12. The grinding compact container of claim 11, wherein the holder guide further comprises a disk part rotatably disposed on an upper surface of a base of the rotary container, the guide column extends upward from the disk part, and the elastic member is disposed on an inner side of the guide column.

* * * * *